US006193228B1

(12) United States Patent
Shimao et al.

(10) Patent No.: US 6,193,228 B1
(45) Date of Patent: Feb. 27, 2001

(54) SHEET SORTING APPARATUS AND METHOD

(75) Inventors: Tetsuro Shimao, Aichi; Koichi Ohmae, Kyoto, both of (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/349,979

(22) Filed: Jul. 9, 1999

(30) Foreign Application Priority Data

Jul. 10, 1998 (JP) ..... 10-195294
Mar. 9, 1999 (JP) ..... 11-061258

(51) Int. Cl.[7] ..... B65H 33/04; B65H 39/02; B65H 39/05; B65H 39/07; B65H 39/045

(52) U.S. Cl. ..... 270/58.32

(58) Field of Search ..... 270/58.32

(56) References Cited

U.S. PATENT DOCUMENTS 2,666,372 * 1/1954 Lauffer ..... 270/58.12
4,749,179 * 6/1988 Hornuug ..... 270/58.12
4,983,096 * 1/1991 Bodewein ..... 271/58.12
5,020,786 * 6/1991 Kimura et al. ..... 271/58.12
5,299,792 * 4/1994 Kollmann et al. ..... 271/58.12

* cited by examiner

*Primary Examiner*—Christopher P. Ellis
*Assistant Examiner*—Kenneth W Bower
(74) *Attorney, Agent, or Firm*—Foley & Lardner

(57) ABSTRACT

A sheet sorting apparatus installed on a sheet discharge side of an image processing apparatus and adapted to paste a tag on a predetermined sheet discharged from the image processing apparatus is disclosed. The apparatus comprises a flapper for switching a path, in which the sheet is transferred to either a first path in which the tag is pasted on the sheet or a second path in which the tag is not pasted on the sheet; draw-out rollers for drawing out a band tape coated at one side edge portion thereof with a pressure-sensitive adhesive; a cutting portion for preparing the tag by cutting the band tape at a predetermined portion thereof; a pasting portion for introducing the prepared tag to a predetermined position with respect to the sheet and pasting the tag on the sheet; at least one receiving tray for receiving the sheet., on which the tag is pasted; and a controller for controlling movements of the flaper, the draw-out rollers and the cutting portion.

41 Claims, 31 Drawing Sheets

FIG. 15

| | | |
|---|---|---|
| 1 | | |
| 2 | | |
| 3 | | |
| 4 | | |
| 5 | | |
| 6 | | |
| 7 | | |
| 8 | | |
| 9 | | |
| 10 | | |
| 11 | | |

FIG. 17

| | ① | ② | (mm) | (ms) |
|---|---|---|---|---|
| 1 | H | L | 5 | 50 |
| 2 | L | H | 7 | 70 |
| 3 | L | H | 7 | 70 |
| 4 | L | H | 7 | 70 |
| 5 | L | L | 10 | 100 |
| —— | H | H | | |

SHEET SORTING APPARATUS AND METHOD

BACKGROUND OF THE INVENTION

1. Field of the Invention

This invention relates to a sheet sorting apparatus, and more particularly to a sheet sorting apparatus provided with a sheet tray and adapted to sort sheets by pasting tags thereon.

2. Description of the Related Art

When sheets are printed out by an image processing apparatus, such as a facsimile transfer unit, a printer and a copier, sheets are discharged in order therefrom and stacked on one tray. During this time, when a sheaf of sheets are taken out from the tray after the printing of one document has finished, a problem does not arise, but, in some cases, sheets of a plurality of documents are discharged continuously and stacked on one tray. In such a case, when sheets are classified by documents and discharged, an end to a document is recognized conveniently on being taken out.

The sorting apparatuses adapted to have such an end to a document recognized include, for example, an offsetting function-carrying apparatus. In this apparatus, sheet discharge positions are staggered by documents. Owing to this arrangement, the positions in which the sheets are discharged are staggered little by little by sheets constituting the same document so that it comes to be understood that the portion of a sheaf of sheets at which a position is staggered shows an end to a document.

There is an apparatus having a function of inserting a ribbon between documents. In this apparatus, however, although a ribbon is placed on sheets discharged onto a tray, and subsequent sheets are discharged onto the ribbon, i.e., ribbons are inserted between the sheets, during the supplying of a ribbon, the discharging of sheets onto the tray is temporarily stopped, so that a ribbon inserting time is required, this causing the productivity to be lowered. Also, since such a ribbon is only held between sheets, there is the possibility that the ribbon falls off when a sheaf of sheets is taken out from the tray, and this causes a problem that a sorting position becomes indefinite.

There is also a method in which a plurality of trays are prepared so as to change trays whenever a document is discharged. This method causes an apparatus therefor to be enlarged, and the manufacturing cost to increase, and such an apparatus cannot be mounted on a small-sized machine.

Further, when sheets read continuously in an image scanner or reader are discharged, the same problems as mentioned above also arise.

Thus, the related art sheet sorting apparatuses have a low productivity, large dimensions and a high manufacturing cost, or a difficulty in carrying out a reliable sorting operation.

SUMMARY OF THE INVENTION

The present invention has been developed in view of such a condition, and an object thereof is to enable reliable sorting to be attained by a simple and small-sized structure, and by pasting tags to be pasted on sheets and discharging the tag-pasted sheets onto a predetermined receiver, to be able to sort sheets easily and reliably with reference to the tags pasted thereon.

The sheet sorting apparatus according to the invention comprises a change-over assembly for switching a path, in which a sheet is transferred, to either a first path in which a tag is pasted on the sheet or a second path in which the tag is not pasted on the sheet, a draw-out assembly for drawing out a band tape coated at one side edge portion thereof with a pressure sensitive adhesive, a cutting assembly for preparing the tag by cutting the band tape at a predetermined portion thereof, a pasting assembly for introducing the prepared tag to a predetermined position with respect to the sheet and pasting the tag on the sheet, a receiving assembly for receiving the sheet on which the tag is pasted by the pasting assembly, and a control assembly for controlling movements of the change-over assembly, draw-out assembly and cutting assembly.

The sheet sorting apparatus according to the present invention may further comprise a structure for transferring the sheet by utilizing a driving force of the image processing apparatus.

Further, the control assembly may vary the width of the tag by controlling a movement of the cutting assembly.

Still further, the draw-out assembly and the cutting assembly may be driven by the same motor.

The sheet sorting apparatus may further comprise a detecting assembly for detecting the position of said cutting assembly.

The sheet sorting method according to the invention comprises the steps of judging a fall of processing demand signal, changing the position of a flapper to direct the sheet to one of at least two paths, drawing out a band tape of a specified length, preparing the tag by cutting the band tape, and pasting the tag on the sheet.

BRIEF DESCRIPTION OF THE DRAWINGS

FIG. 15 is a drawing describing signals inputted from the printer into the sheet sorting apparatus, and signals outputted from the sheet sorting apparatus to the printer.

FIG. 17 is a drawing describing the relation between tag width signals ①, ②, and time t1.

DESCRIPTION OF THE PREFERRED EMBODIMENTS

The modes of embodying the present invention will now be described.

Figure 3:
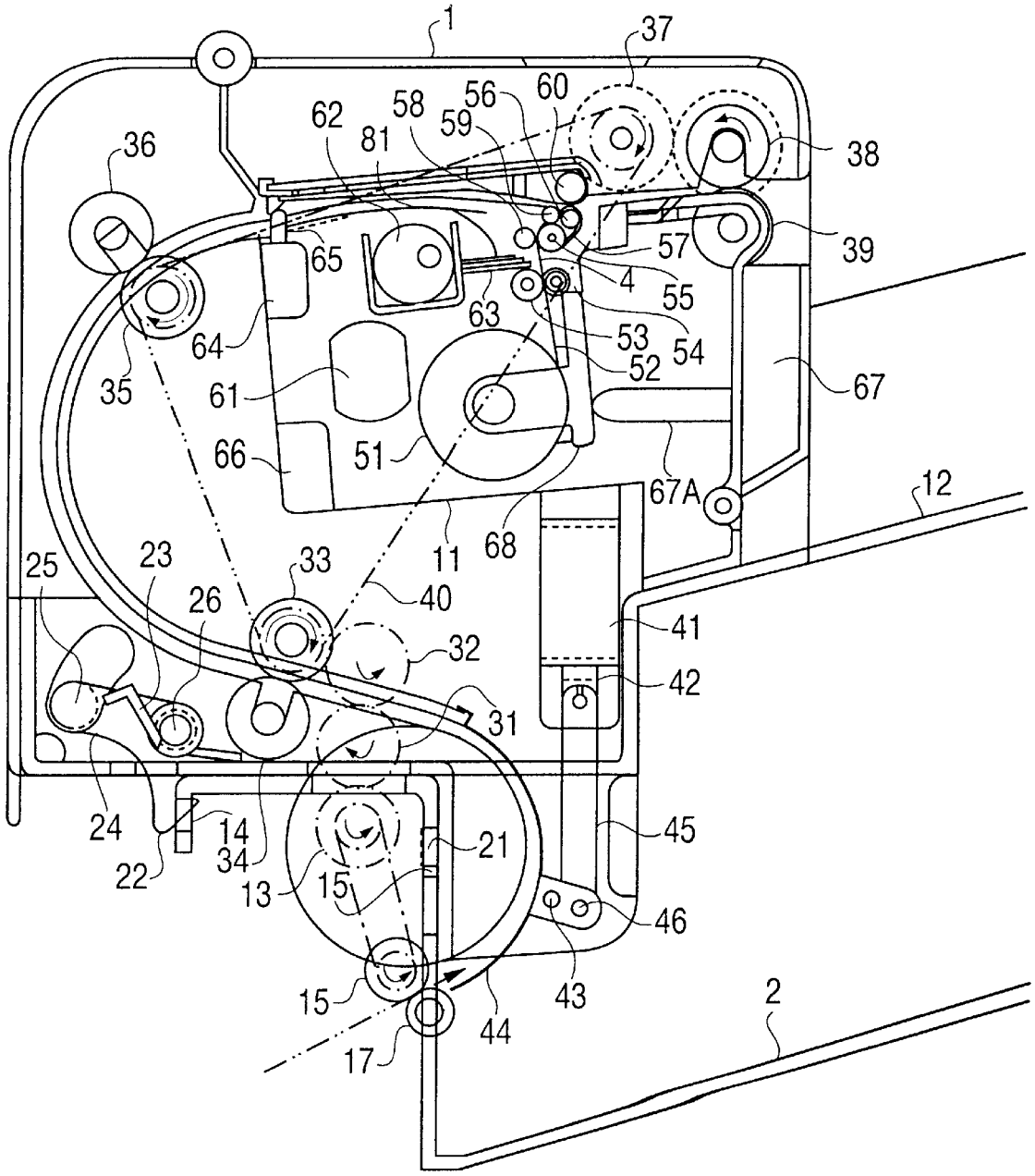
FIG. 3 is a drawing showing the construction of a mode of embodiment of the sheet sorting apparatus.

The sheet sorting apparatus defined in claim 1 is characterized in that it includes a change-over assembly (for example, a flapper 44 of FIG. 3) for switching a path, in which a sheet is transferred, to either a first path in which a tag is pasted on the sheet or a second path in which the tag is not pasted thereon, a draw-out assembly (for example, draw-out rollers 53, 54 of FIG. 3) for drawing out a band tape coated at one side edge portion thereof with a pressure sensitive adhesive, a cutting assembly (for example, a cutting portion 63 of FIG. 3) for preparing the tag by cutting the band tape at a predetermined portion thereof, a pasting assembly (for example, a tag pasting belt 57 and a transfer roller 60 of FIG. 3) for introducing the prepared tag to a predetermined position on the sheet, holding the tag from both sides thereof with a part thereof superposed on the sheet, and pasting the tag on the sheet, a receiving assembly (for example, a tray 12 for discharged sheet of FIG. 3) for receiving the sheet, on which the tag is pasted by the pasting assembly, and a control assembly (for example, a controller 66 of FIG. 3) for controlling movements of the changeover assembly, draw-out assembly and cutting assembly.

Figure 1:
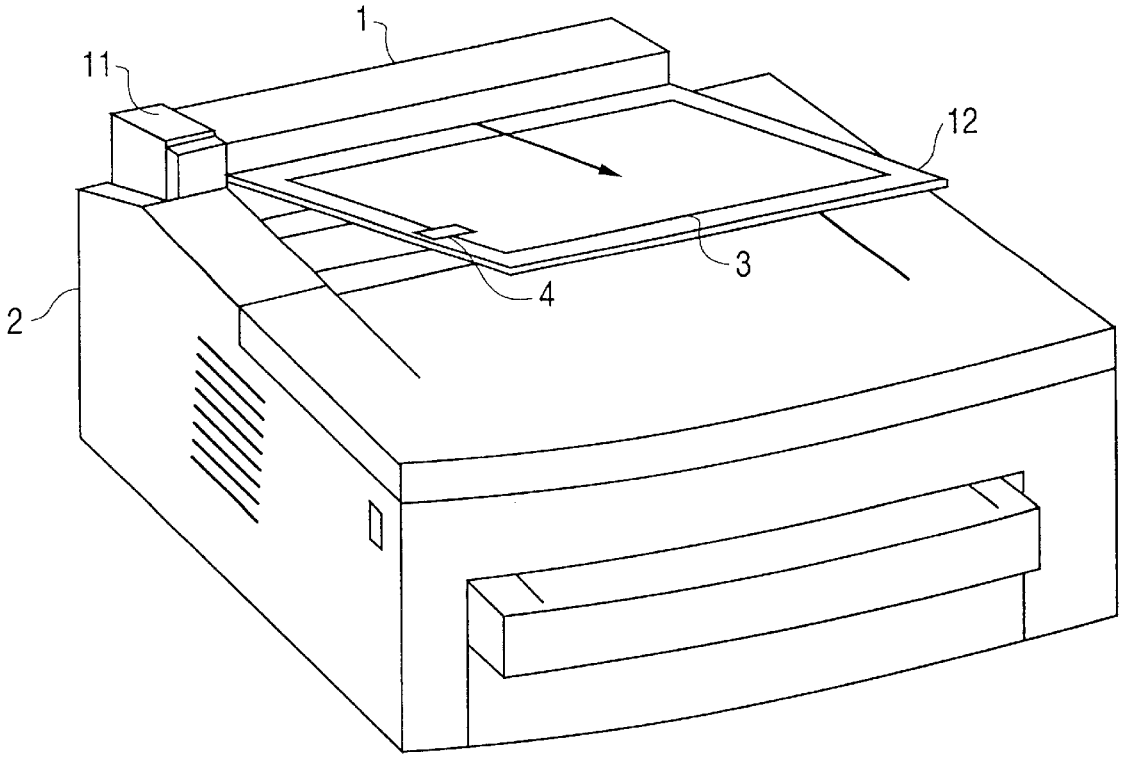
FIG. 1 (PRIOR ART)
FIG. 1 is a drawing showing a mode of embodiment of the present invention.

FIG. 1 is a diagram showing a first mode of embodiment of the present invention. A sheet sorting apparatus 1 is installed at an upper portion of a discharge port for a sheet 3 of a printer 2, and a pasting operation is carried out during the transfer of the sheet without stopping a discharge operation of the printer 2. The sheet sorting apparatus 1 has a tag pasting portion 11 and a tray 12 for discharged sheets. The sheets 3 on which the tags 4 are pasted are stacked on the tray 12 for discharged sheet after the sheets 3 have been discharged from the sheet sorting apparatus 1.

Figure 2:
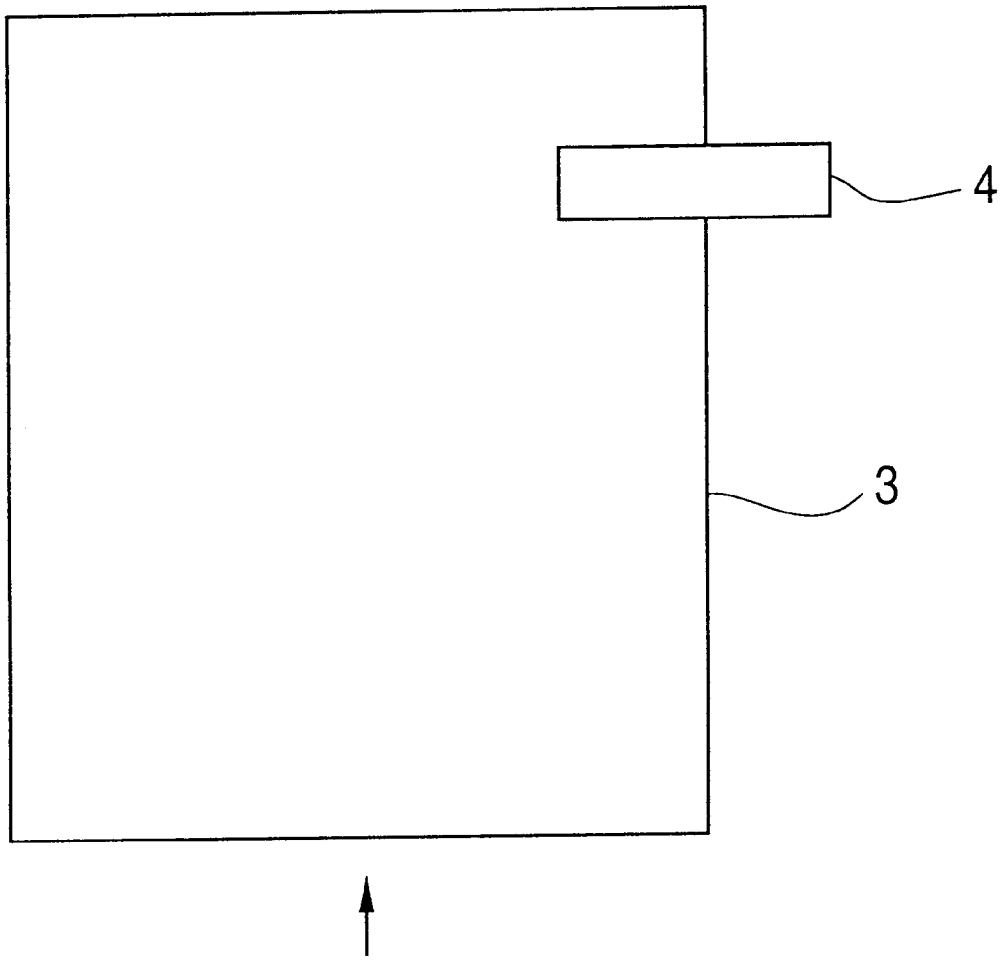
FIG. 2 is a drawing showing a sheet on which a tag is pasted.

FIG. 2 is a diagram showing a sheet 3 on which the tag 4 is pasted by the sheet sorting apparatus 1. The sorting of the sheets 3 on the tray 12 for discharged sheet is carried out with the pasted tags 4.

FIG. 3 is a diagram showing the construction of the first mode of embodiment of the sheet sorting apparatus 1. The sheet sorting apparatus 1 is fixed to the printer 2 by inserting a projecting portion 21 of the apparatus 1 into a hole 15 of the printer 2, and hanging a hook 22 on another hole 14 of the printer 2.

Figure 4:
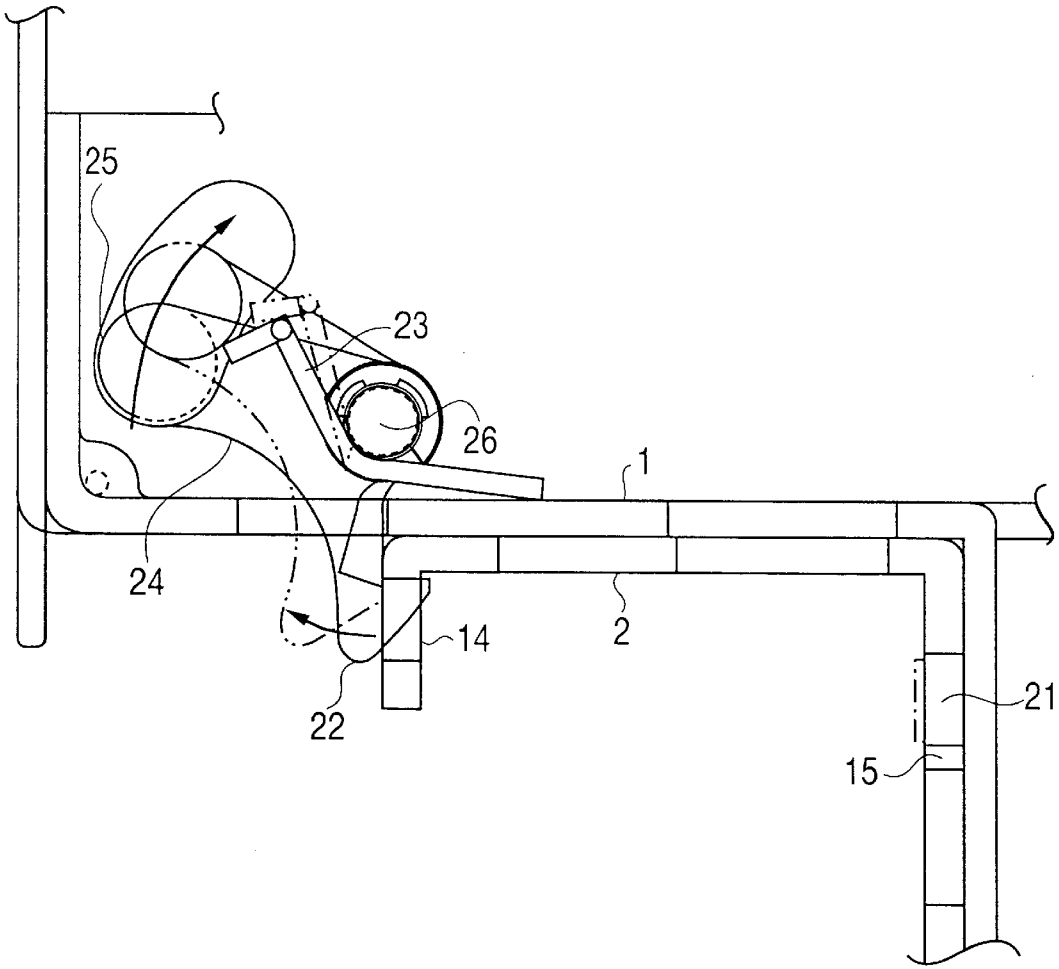
FIG. 4 is a drawing describing an operation carried out when the sheet sorting apparatus is fixed to and removed from a printer.

FIG. 4 is a diagram describing an operation for fixing and removing the sheet sorting apparatus 1 to and from the printer 2. A lever 25 is pivotably fixed to the sheet sorting apparatus 1 via a shaft 26. The lever 25 can be turned around the shaft 26 in an arc of within a predetermined angle in a direction of an arrow in FIG. 4, and is normally urged by a spring 23 so that the hook 22 is inserted into the hole 14 of the printer 2. When the sheet sorting apparatus 1 is removed from the printer 2, the lever 25 is turned against a resilient force of the spring 23 in a direction in which the hook 22 leaves the hole 14 of the printer 2, and the sheet sorting apparatus 1 may be drawn apart from the printer 2.

Figure 5:
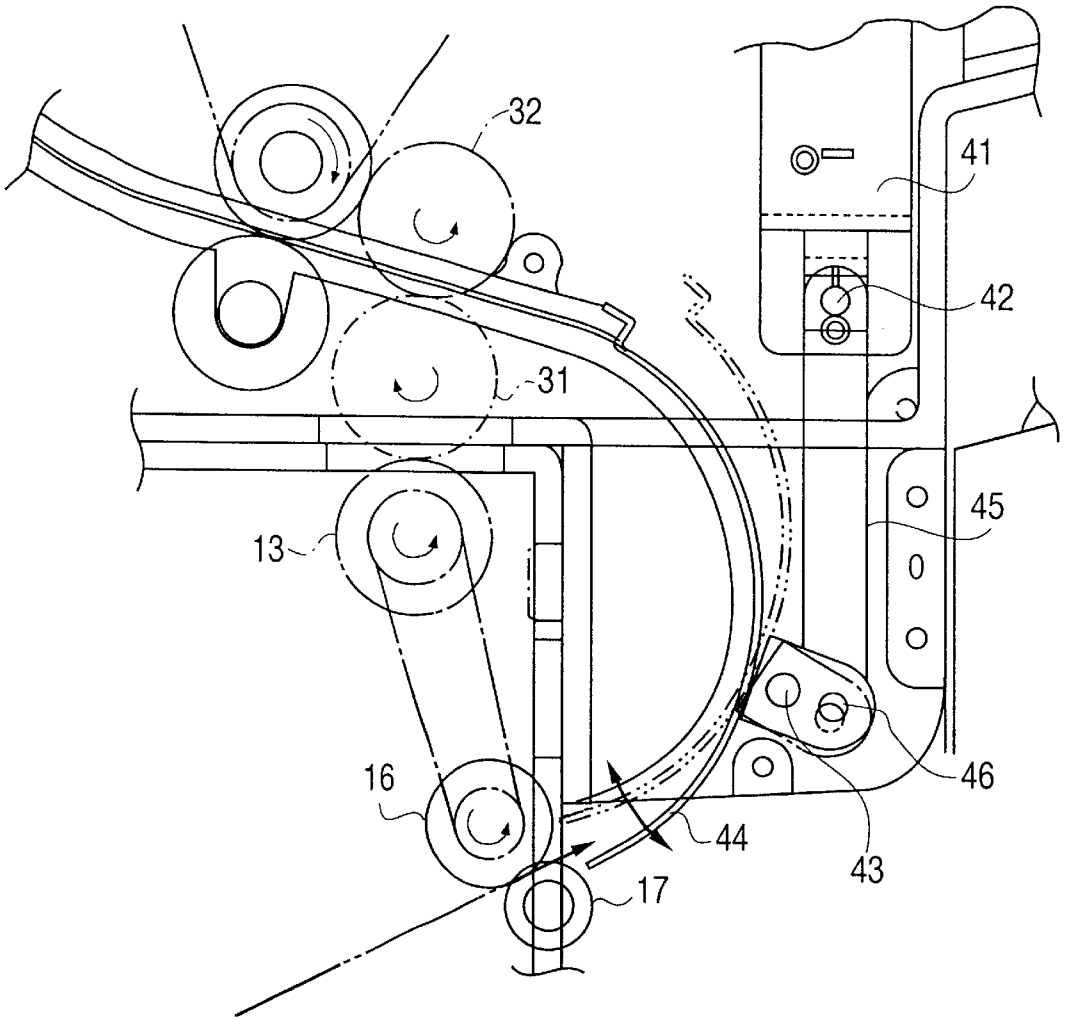
FIG. 5 is a drawing describing an operation of a mechanism for switching a transfer path for the sheet.

FIG. 5 is a diagram describing an operation of a mechanism for switching the path in which a sheet 3 is transferred. The flapper 44 is turned clockwise or counter-clockwise around a shaft 43. When the flapper 44 is in a position shown by a solid line (turned counter-clockwise) in the drawing, a sheet 3 sent by sheet discharge rollers 16, 17 of the printer 2 is sent to the sheet sorting apparatus 1. When the flapper 44 is in a position shown by a broken line (turned clockwise) in the drawing, the sheet 3 sent by the sheet discharge rollers 16, 17 of the printer 2 is discharged onto a tray for discharged sheets in the printer 2.

A plunger 42 of a solenoid 41 is combined with one end of a link 45. The other end of the link 45 is combined with a pin 46 of the flapper 44. When a voltage applied to the solenoid 41 is zero volt, i.e., when the solenoid 41 is in an off-state (a non-excited state), the flapper 44 is turned clockwise around the shaft 43 by an urging force of a spring (not shown), and the plunger 42 takes an outwardly (downwardly in FIG. 5) projecting position due to the link 45.

When the solenoid 41 is in an on-state (excited state), it draws the plunger 42 toward a case for the solenoid 41 against the urging force of the spring, so that the pin 46 is moved up in FIG. 5 via the link 45. Accordingly, the flapper 44 is turned counterclockwise around the shaft 43 to take a position in which it contacts a transfer path in the sheet sorting apparatus 1.

As described above, the flapper 44 is moved by the voltage applied to the solenoid 41, and the transfer path of the sheet 3 is switched to the side of the tray for discharged sheet in the printer 2, or to the side of the sheet sorting apparatus 1.

Figure 6:
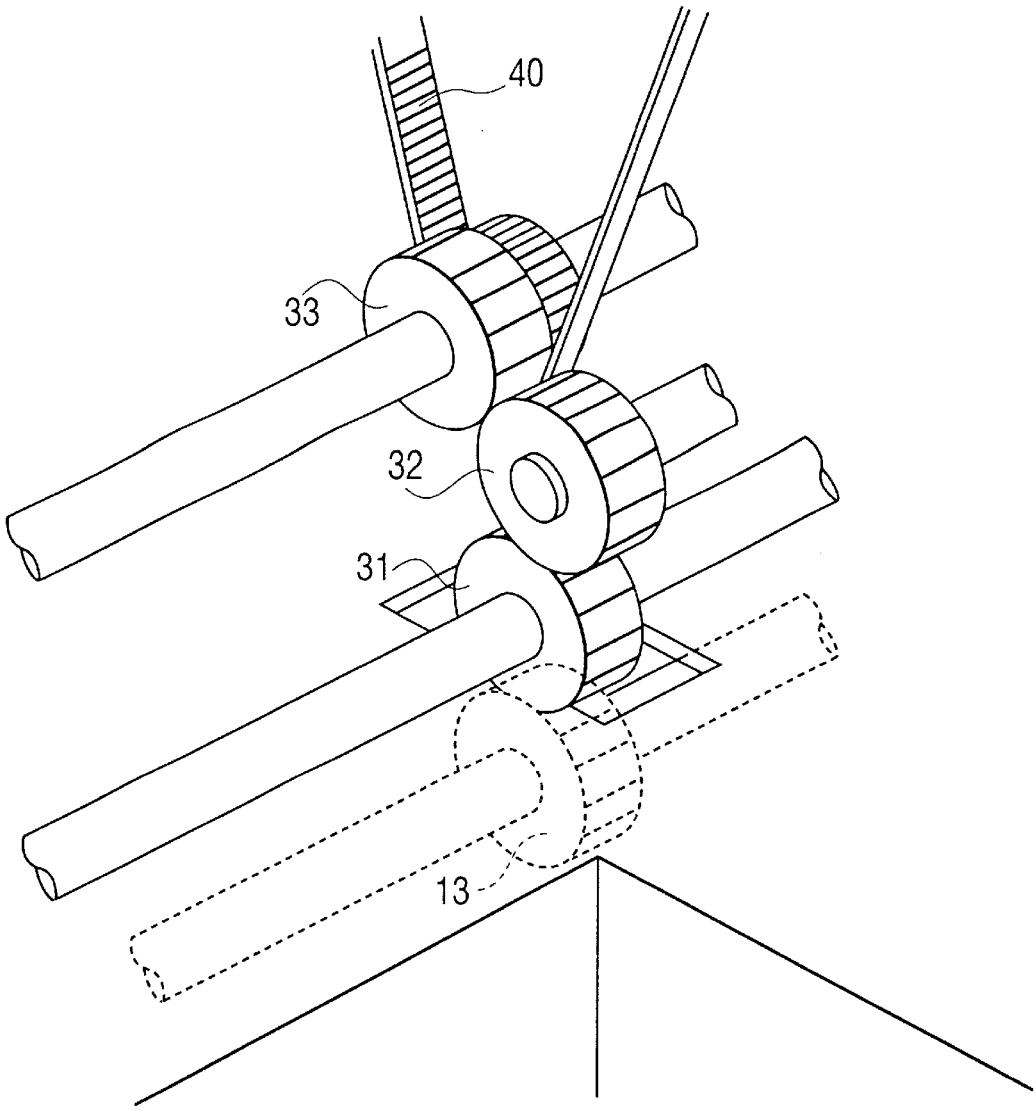
FIG. 6 is a drawing describing the transmission of a driving force of a sheet discharge roller of the printer.

Returning to FIG. 3, a driving force of the sheet discharge roller 16 of the printer 2 is transmitted to the sheet sorting apparatus 1 via a belt and a transmission gear 13. FIG. 6 is a diagram describing the transmission of the driving force of the sheet discharge roller 16 of the printer 2. When the sheet sorting apparatus 1 is fixed to the printer 2, the transmission gear 13 to which the driving force of the sheet discharge roller 16 of the printer 2 is transmitted engages a transmission gear 31 of the sheet sorting apparatus 1 to transmit the driving force thereto. The transmission gear 31 transmits the driving force to a transfer roller 33 via a transmission gear 32. The driving force of the transfer roller 33 is transmitted to another transfer roller 35 and a transmission gear 37 of the sheet sorting apparatus 1 shown in FIG. 3 via a gear (rotated with the transfer roller 33) mounted fixedly on the same shaft as the transfer roller 33 and a toothed belt 40. The driving force of the transmission gear 37 is transmitted to a transfer roller 38. The sheet 3 transferred to the side of the sheet sorting apparatus 1 is transferred at a predetermined speed as it is held between the transfer roller 33 and a driven roller 34, the transfer roller 35 and a driven roller 36 and a transfer roller 38 and a driven roller 39, to be discharged onto a tray 12 for discharged sheet.

Thus, the driving force for transferring the sheet 3 in the sheet sorting apparatus 1 is preferably supplied from the printer 2.

A tag pasting portion 11 of the sheet sorting apparatus 1 is provided with a limit switch 64 in an introduction path for the sheet 3, and a front edge of the sheet 3 is detected by a lever 65 of this limit switch 64.

Figure 7:
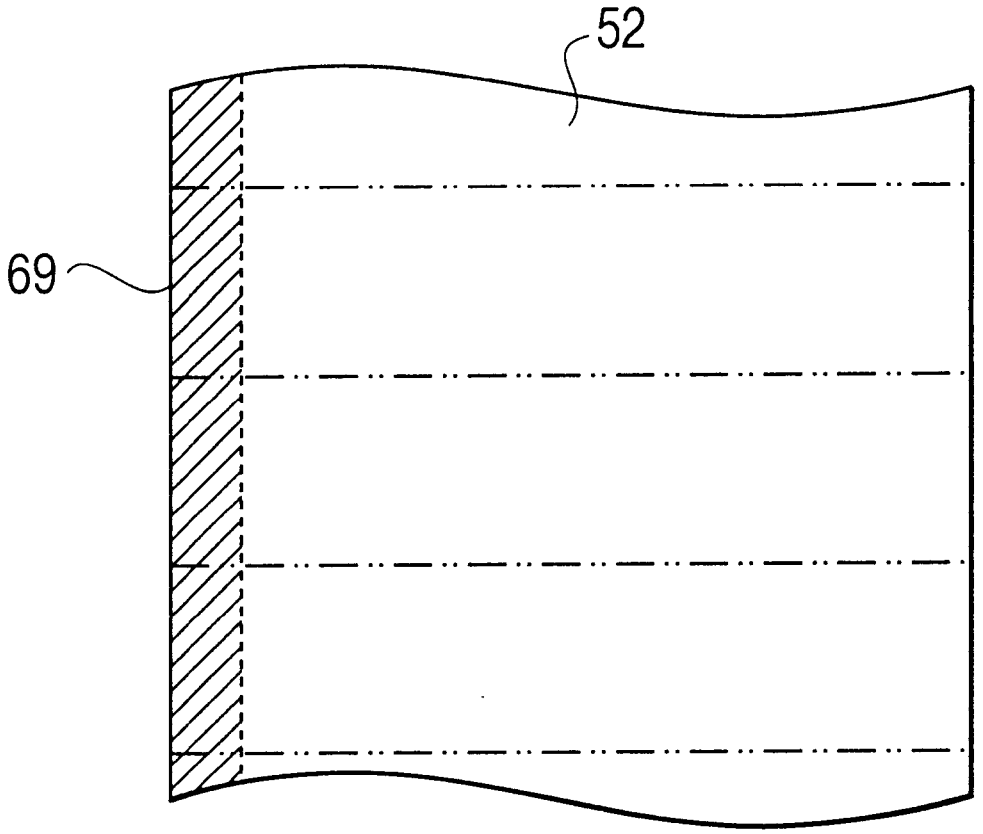
FIG. 7 is a drawing describing a band tape.

A roll case 68 is provided removably in the interior of the tag pasting portion 11. The roll case 68 retains a sheet roll 51 rotatably therein. This sheet roll 51 is a roll having a sheet band tape 52 taken up. This band tape 52 is coated at one side edge portion thereof with a pressure sensitive adhesive 69 as shown in FIG. 7. A pair of draw-cut rollers 53, 54 are adapted to guide the band tape 52, which is drawn out continuously from the sheet roll 51, to a predetermined position.

Above the draw-out rollers 53, 54, a cutting portion 63 is provided, which is adapted to cut the drawn-out band tape 52 to a predetermined length with a forwardly moved upper edge 81, to form a tag 4. The tag 4, separated one by one from a front end of the band tape 52, is transferred by guide rollers 58, 59 and tag pasting belt 57 and guided so that the tag contacts a predetermined portion of a side edge of the sheet 3. The tag pasting belt 57 is adapted to be rewound between a driving pulley 55 and a driven pulley 56, and generally turned clockwise or counter-clockwise at an angle in a predetermined range around the driving pulley 55. When the portion of the tag pasting belt 57 which is on the side of the driven pulley 56 is turned counter-clockwise, the tag pasting belt 57 and a transfer roller 60 contact each other to hold the sheet 3 and tag 4 therebetween, and transfer the sheet and tag while pressing them at a predetermined pressure. Since the portion coated with the adhesive 63 of the tag 4 is thus brought into pressure contact with the sheet 3, the sheet 3 and tag 4 are pasted on each other.

Since a rotational speed of the tag pasting belt 57 and that of the transfer roller 60 are set equal while these belt and roller are driven synchronously with a transfer movement of the sheet 3, the tag 4 can be pasted on the sheet 3 by a series of operations without stopping the transfer movement of the sheet 3. In an initial condition, the driven pulley 56 is in a position to which it has been turned clockwise (moved down in the drawing), and the tag pasting belt 57 and transfer roller 60 are separated by a predetermined distance, so that the transfer of the sheet 3 is not prevented.

The draw-out roller 53, cutting portion 63 and tag pasting belt 57 are combined suitably with a tacking action motor 61, and rotated intermittently at predetermined times. When the tacking action motor 61 is rotated forward, a driving force thereof is transmitted to the draw-out roller 53, tag pasting belt 57 and transfer roller 60, and not to an eccentric cam 62 which drives the cutting portion 63. When the tacking action motor 61 is rotated reversely, the driving force thereof is transmitted to the eccentric cam 62, and not to the draw-out roller 53, tag pasting belt 57 and transfer roller 60. A storage box 67 is detachable, and stores therein tags 4 not pasted on (wasted) the sheet 3, which occurs during the installation of the sheet roll 51, and the adhesive deposited on the cutting portion 63 and dropped due to a movement thereof. The tags 4 and adhesive stored in the storage box 67 are discarded at a suitable time. The storage box 67 has a projection 67A adapted to push a release lever 73 of a roll case 68 which will be described later. A controller 66 is adapted to control the driving of the tack action motor 61 on the basis of signals from and data stored in the interior of the printer 2 and limit switch 64 and data stored therein.

Figure 8A:
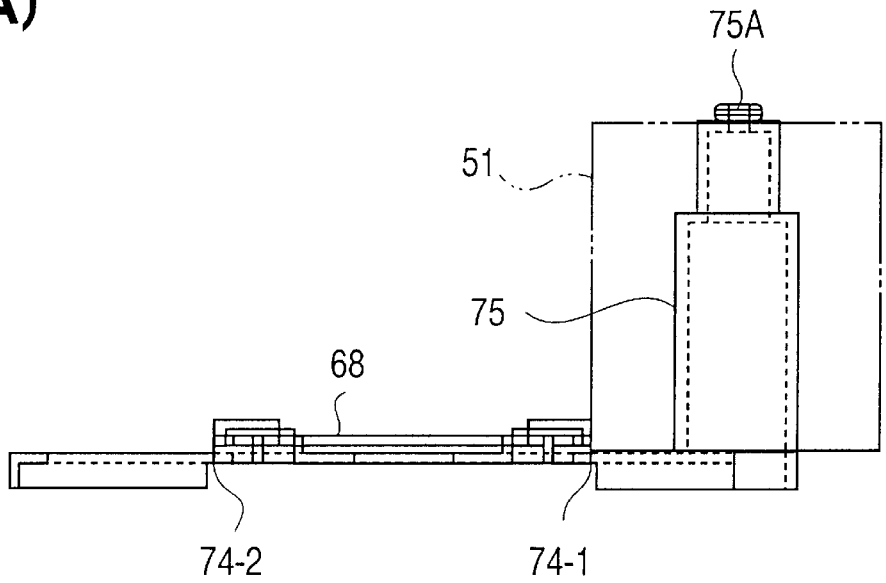
FIGS. 8(A) and 8(B) are drawings describing a roll case.
Figure 8B:
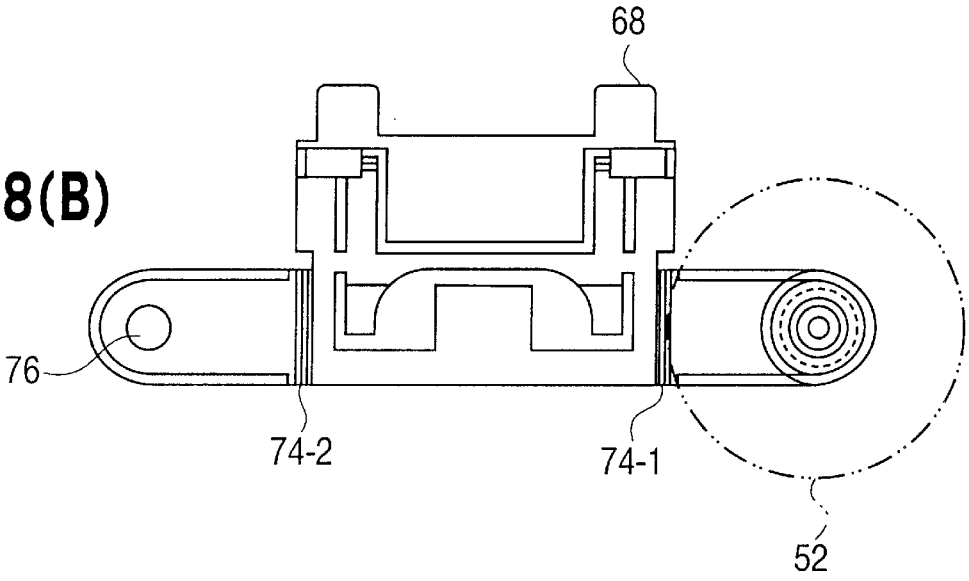

The installation of the sheet roll 51 in the roll case 68 will now be described. FIG. 8(A) is a top view of the roll case 68 in which the sheet roll 51 has not yet been installed. FIG. 8(B) is a front view of the roll case 68 in which the sheet roll 51 has not yet been installed. In a procedure for installing the sheet roll 51 in the roll case 68, a rotary shaft 75 for the roll is inserted into a central hole of the sheet roll 51, and the roll case 68 is bent at bending portions 74-1, 74-2, then a hole 76 of the roll case 68 is fitted around a front end portion 75A of the rotary shaft 75.

Figure 9B:
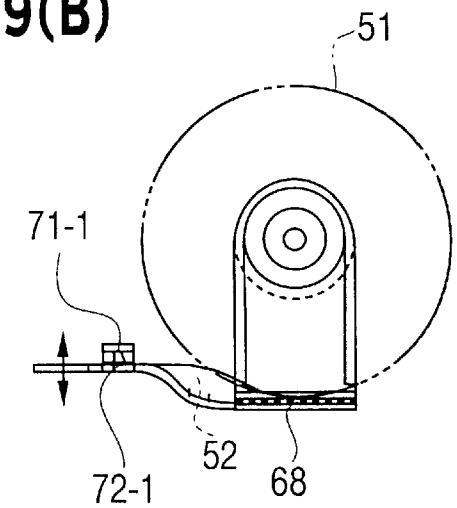
FIGS. 9(A), 9(B) and 9(C) are drawings describing the roll cairn.
Figure 9A:
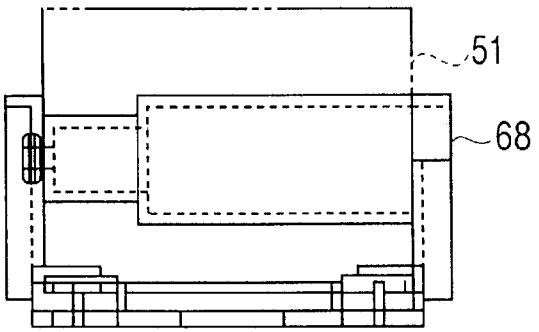

FIG. 9(A) is a top view of the roll case 68 in which the sheet roll 51 has been installed. Since the rotary shaft 75 of the roll is inserted in the sheet roll 51 so that a position of a side surface of the sheet roll 51 is limited, only a rotational movement thereof around the rotary shaft 75 can be made with respect to the roll case 68.

A front end of the band tape 52 on the sheet roll 51 is then set in a predetermined position in the roll case 68. FIG. 9(B) is a side view of the roll case 68 in which the sheet roll 51 has been installed. The portion of the roll case 68 from which the band tape 52 is drawn out is provided with a retainer lever 72-1 and a tape end holder 71-1. The roll case 68 is provided in a position contacting an end portion thereof, which is opposite to the end portion thereof which the retainer lever 72-1 and a tape end holder 71-1 for the band tape 52 contact, with a retainer lever 72-2 and a tape end holder 71-2, though they are not shown in FIG. 9(B).

The retainer lever 72-1 is urged so as to be pressed against the tape end holder 71-1. The retainer lever 72-1 is turned against this urging force so as to be separated from the tape end holder 71-1, and the front end of the band tape 52 on the sheet roll 51 is inserted into a clearance between the tape end holder 71-1 and retainer lever 72-1. The same operation is carried out with respect to the tape end holder 71-2 and retainer lever 72-2 as well. Consequently, even when vibration is applied to the roll case 68 during an operation for fixing the roll case 68 to the tag pasting portion 11, the band tape is securely held in position in directions perpendicular to the plane of the band tape 52 with respect to the roll case 68 (positions in the directions shown by arrows in FIG. 9(B)).

Figure 9C:
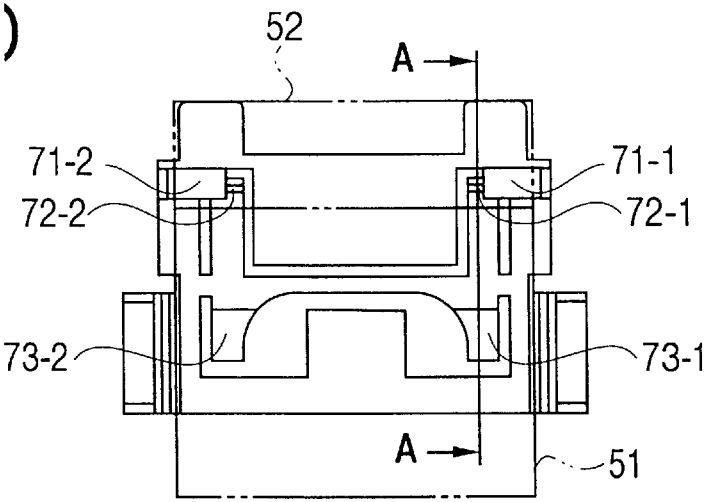

FIG. 9(C) is a front view of the roll case 68 in which the sheet roll 51 has been installed. The tape end holders 71-1, 71-2 and retainer levers 72-1, 72-2 hold end portions on both sides of the front end of the band tape 52 therebetween. The roll case 68 is provided with release levers 73-1, 73-2 for turning the retainer levers 72-1, 72-2 in a direction in which these levers leave the tape end holders 71-1, 71-2.

Figure 10:
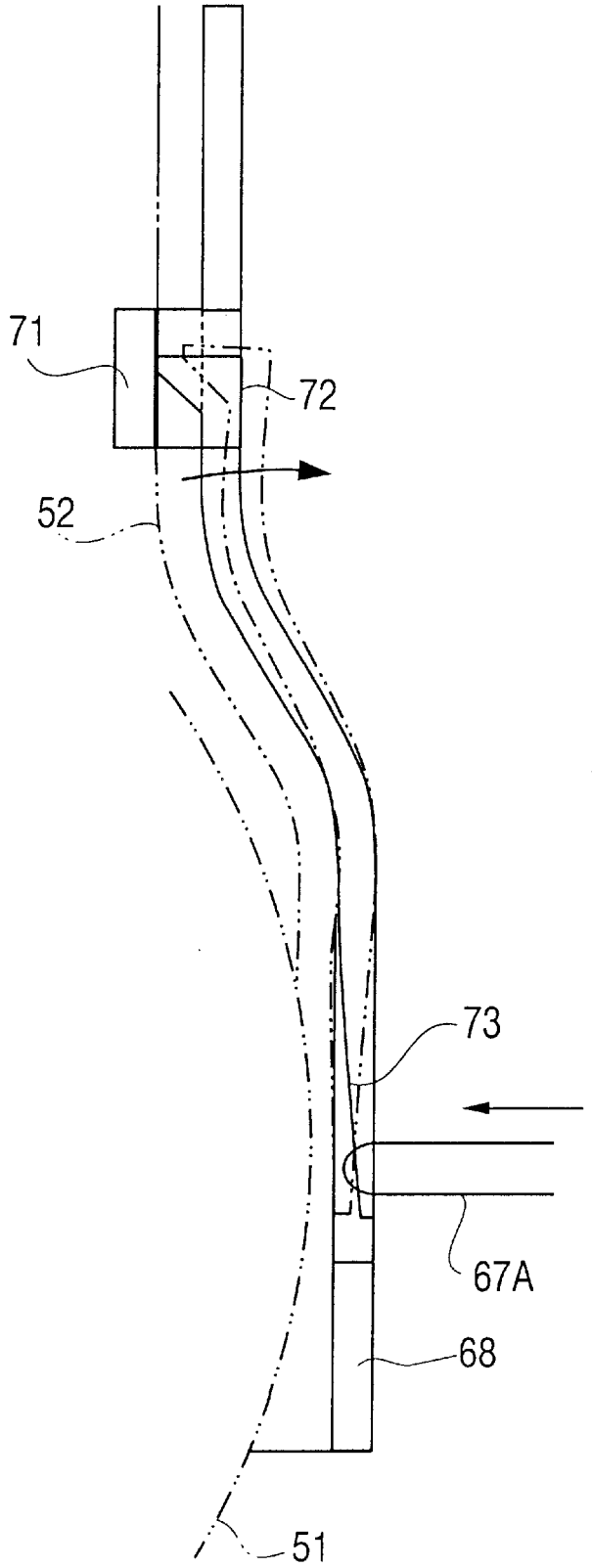
FIG. 10 is a drawing describing an operation of a retainer lever performed by a projection of a storage box.

FIG. 10 is a diagram taken along a section A—A in FIG. 9(C), and describes a movement of a retainer lever 72 made by a projection 67A of the storage box 67. When the storage box 67 is fixed to the tag pasting portion 11 in which the roll case 68 is installed, the projection 67A of the storage box 67 pushes the release lever 73 of the roll case 68 in the direction of an arrow in FIG. 10. As a result, the retainer lever 72 is turned in the direction in which it leaves the tape end holder 71, to release the band tape 52. During this time, the band tape 52 is held between the draw-out rollers 53, 54, so that it is retained in a predetermined position. Employing such a structure enables the sheet roll 51 to be set easily and reliably, and prevents unnecessary resistance from being exerted on the band tape 52 during an operation of the sheet sorting apparatus 1.

Figure 11:
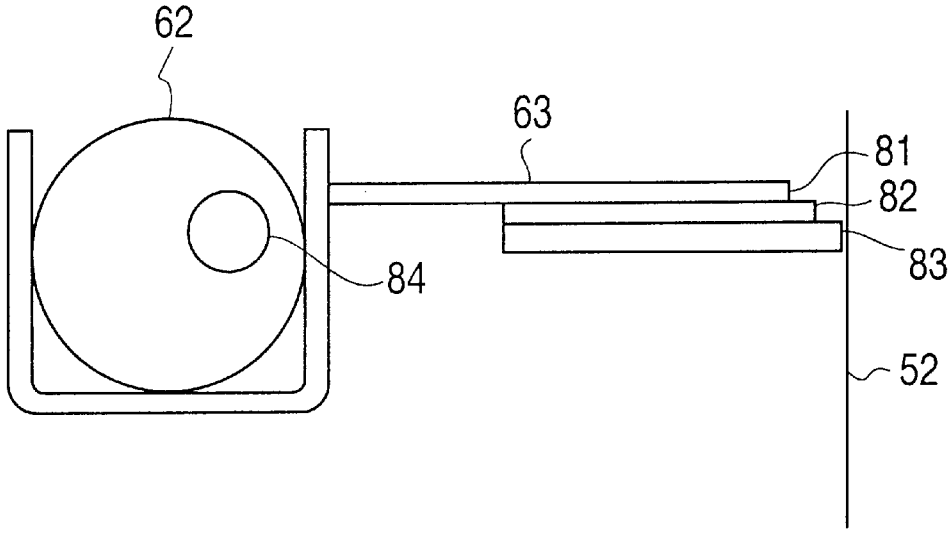
FIG. 11 is a drawing showing the construction of a cutting portion and an eccentric cam.

The construction of the cutting portion 63 will now be described. FIG. 11 is a diagram showing the construction of the cutting portion 63 and eccentric cam 62. The cutting portion 63 comprises an upper edge 81, a lower edge 82 and a guide 83. The lower edge 82 and guide 83 are fixed to the tag pasting portion 11. When the eccentric cam 62 is turned around a shaft 84, the upper edge 81 slidingly moves on the lower edge 82 in the direction of an arrow in the drawing to cut the band tape 52. When the eccentric can 62 is further turned after the cutting of the band tape 52 has been done, the upper edge 81 returns to the original position (position in the drawing).

Figure 12:
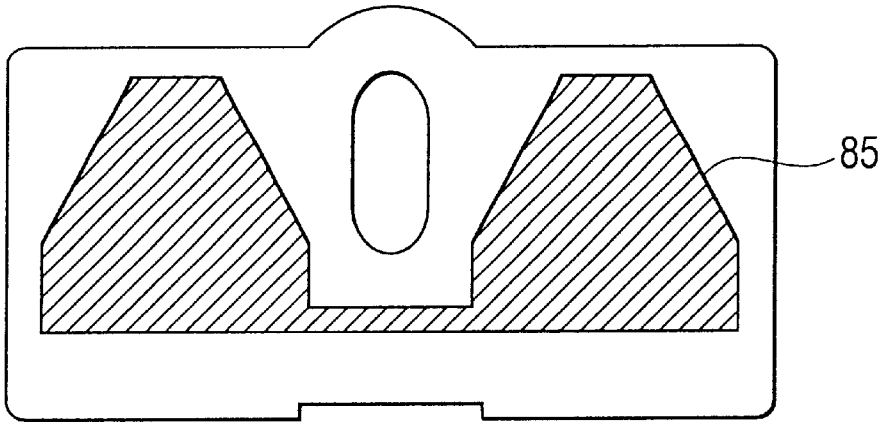
FIG. 12 is a drawing showing the construction of a lover edge.

FIG. 12 is a diagram showing the construction of the lower edge 82. When the cutting of the band tape 52 is done repeatedly, the adhesive 69 is deposited on the upper edge 81. When the adhesive 69 deposited on the upper edge 81 is deposited on a portion between the upper and lower edges 81, 82 due to the sliding movement of the upper edge 81, a very high sliding resistance occurs. The lower edge 82 has a hole 85 which decreases a touch area thereof with respect to the upper edge 81, and sliding resistance thereof.

Figure 13:
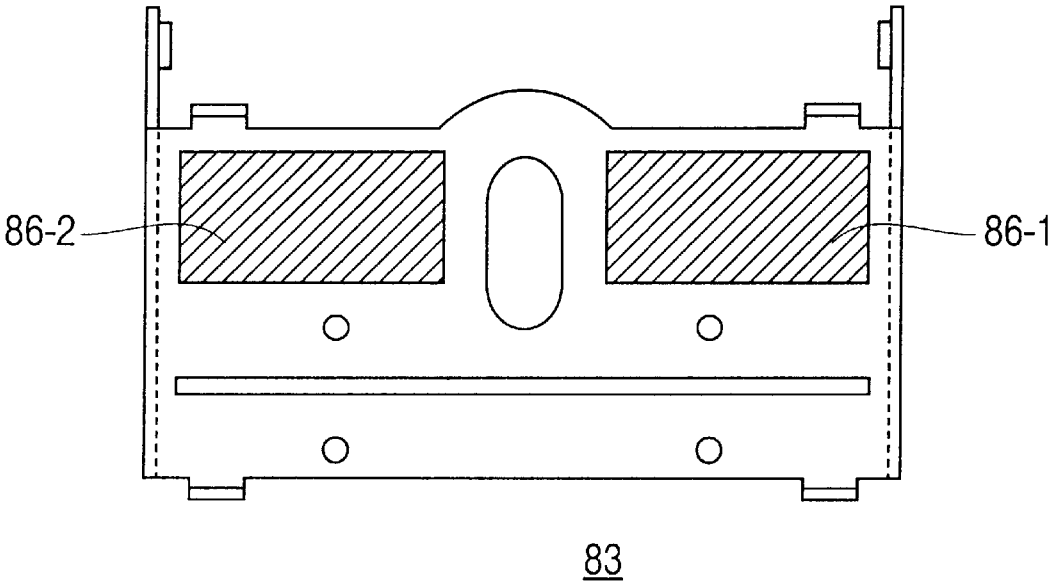
FIG. 13 is a drawing showing the construction of a guide.

FIG. 13 is a diagram showing the construction of the guide 83. In the same manner as in the case of the lower edge 82, when the adhesive 69 deposited on the upper edge 81 is deposited on a portion between the upper edge 81 and guide 83, a very high sliding resistance occurs. The guide 83 has holes 86-1, 86-2 which decrease an area of the portion, on which the adhesive 69 is deposited, between the guide 83 and upper edge 81, and thus sliding resistance.

Because the lower edge 82 and guide 83 are formed in this manner, the cutting portion 63 can be operated stably.

Figure 14B:
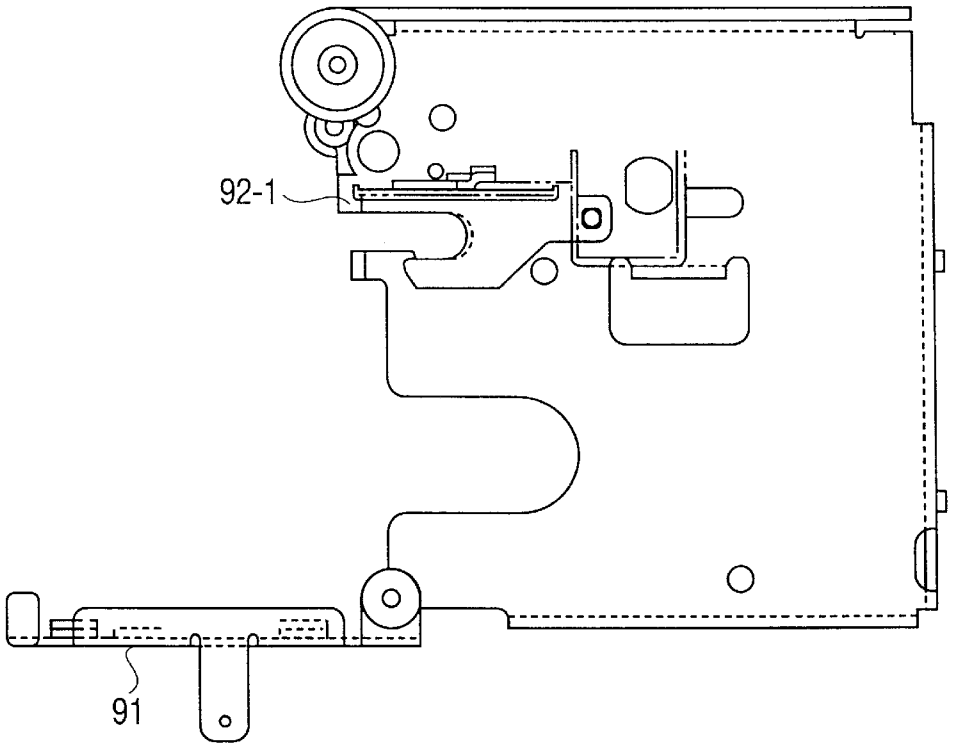
FIGS. 14(A) and 14(B) are drawings describing the covering of the cutting portion.
Figure 14A:
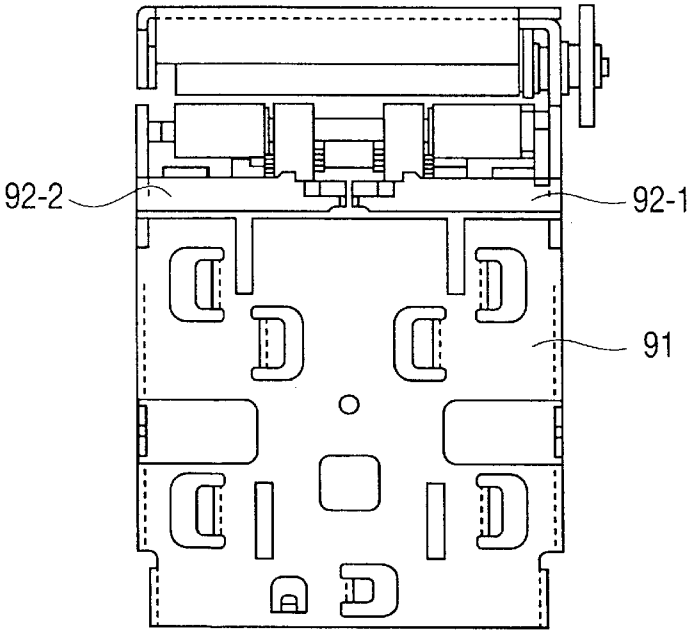

FIG. 14 is a diagram describing the covering of the cutting portion 63. FIG. 14(A) is a front view of the tag pasting portion 11. Separately from a cover 91 opened and closed at the time of installation of the roll case 68 in which the sheet roll 51 is installed, covers 92-1, 92-2 for the cutting portion are provided. Therefore, even at the time of installation of the roll case 68, the cutting portion 63 is not exposed, and these covers prevent the upper and lower edges 81, 82 from hurting a user. FIG. 14(B) is a side view of the tag pasting portion 11 with the cover 91 opened. Even when the cover 91 is opened, the cutting portion 63 is covered with the covers 92-1, 92-2 therefor.

The operation of the sheet sorting apparatus 1 will now be described. FIG. 15 is a diagram describing signals inputted from the printer 2 into the sheet sorting apparatus 1, and signals outputted from the sheet sorting apparatus 1 to the printer 2. A processing demand signal inputted from the printer 2 into the sheet sorting apparatus 1 is a signal indicating that the printer 2 sends a sheet 3 to the sheet sorting apparatus 1.

Tag width signals ①, ② inputted from the printer 2 into the sheet sorting apparatus 1 are signals indicating that the pasting of the tag 4 on the sheet 3 is to be done or not, and designating a width of the tag 4. Tag pasting position signals ①–④ inputted from the printer 2 into the sheet sorting apparatus 1 are signals designating positions in which tags 4 are to be pasted on sheets 3.

A roll end signal outputted from the sheet sorting apparatus 1 to the printer 2 as a signal indicating that the portion of the sheet roll 51 which is in the vicinity of a terminal end thereof is detected. Jam signals ①, ② outputted from the sheet sorting apparatus 1 to the printer 2 are signals indicting the condition of the stopping of a sheet in the sheet sorting apparatus 1. A flapper signal inputted from the printer 2 into the sheet sorting apparatus 1 is a signal designating the switching of the flapper 44.

Figure 16:
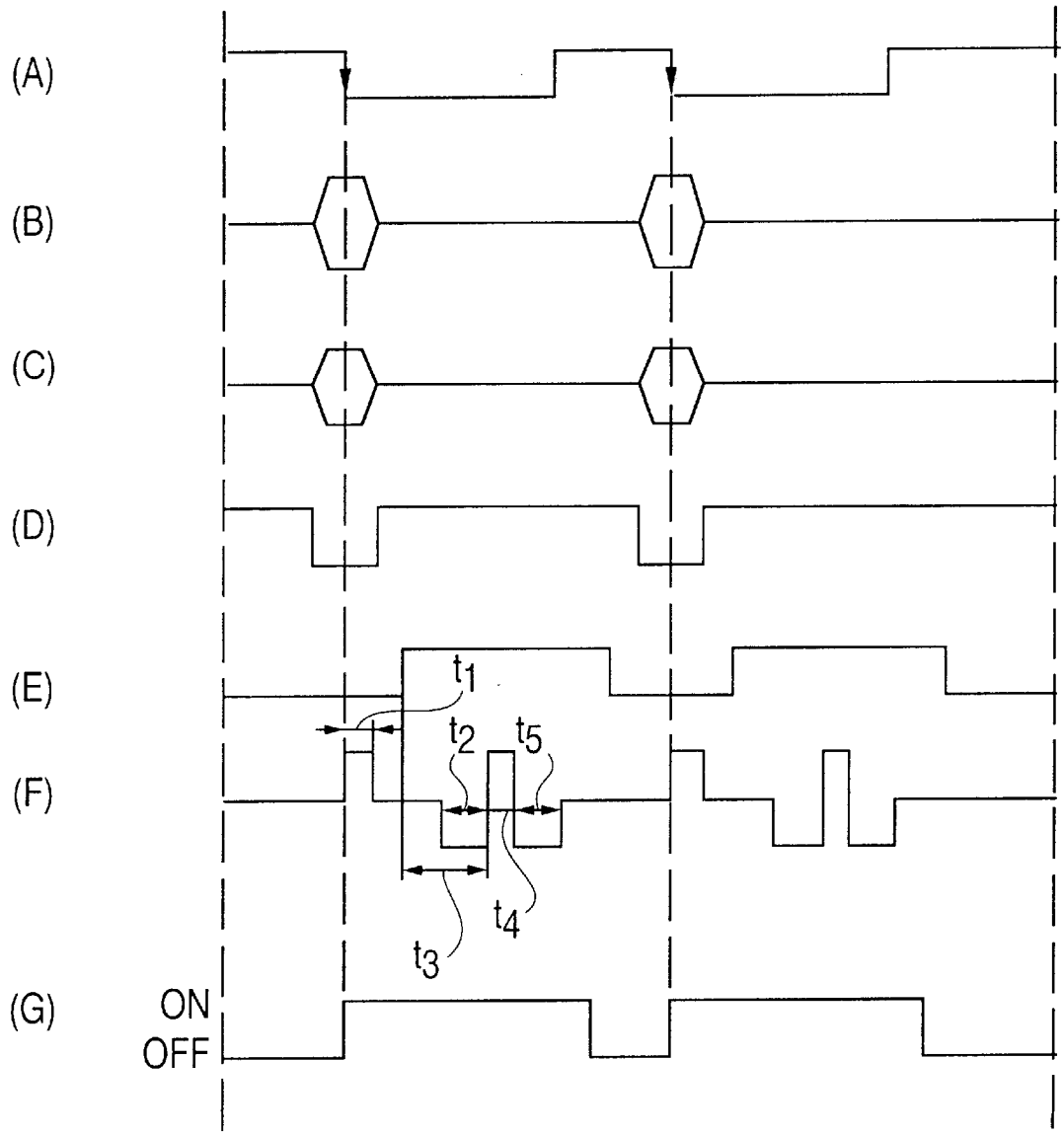
FIG. 16 is a drawing describing the timing of signals.

FIG. 16 is a diagram describing the timing of signals inputted from the printer 2 into the sheet sorting apparatus 1, and signals in the interior of the sheet sorting apparatus 1. FIG. 16(A) is a diagram showing the variation of a processing demand signal. The processing demand signal falls at 500 ms before the sheet 3 has been sent from the printer 2 to the sheet sorting apparatus 1. The tag pasting signals ①, ② shown in FIG. 16(B), tag pasting position signals ①–④ shown in FIG. 16(C) and flapper signal shown in FIG. 16(D) are read by the sheet sorting apparatus 1 at the time of fall of the processing demand signal.

FIG. 16(E) is a diagram showing a front end detecting signal, i.e., an output signal from the limit switch 64 whereby the front edge of the sheet 3 varies when the lever 65 is operated. The front end detecting signal rises when the front edge of the sheet 3 has reached the tag pasting portion 11.

FIG. 16(F) is a diagram showing the variation of a motor operating signal outputted from the controller 66 of the sheet sorting apparatus 1 and controlling the rotation of the tacking action motor 61. The motor operating signal takes a value for forwardly rotating the tacking action motor 61 during a time t1 from the time of fall of the processing demand signal to the time corresponding to the tag width signals ①, ②. The time t1 for forwardly rotating the tacking action motor 61 is the time for drawing out the band tape 52 held between the draw-out rollers 53, 54, and the length of the time determines a width of the tag 4.

FIG. 17 is a diagram describing the relation between the tag width signals ①, ② and time t1. In this mode of embodiment, the printer 2 demands that a tag 4 of a width corresponding to the number of sheets handled in a printing job be pasted on a first sheet 3 subjected to the printing job. Namely, the printer 2 sets the tag width signal ① to H, and the tag width signal ② to L when the number of sheet handled in a printing job is 1. The printer 2 sets the tag width signal ① to L, and the tag width signal ② to H when the number of sheets handled in a printing job is 2–4, and the tag width signal ① to L, and the tag width signal ② to L when the number of sheets handled in a printing job is not less than 5.

When the tag width signal ① is H with the tag width signal ② being L, the controller 66 of the sheet sorting apparatus 1 sets the width of the tag 4 to 5 mm, so that the time t1 for forwardly rotating the tacking action rotor 61 is set to 50 ms. The time corresponding to the tag width signals ①, ② is stored in the interior of the controller 66 in advance. Similarly, the controller 66 sets the width of the tag 4 to 7 mm when the tag width signal ① is L with the tag width signal ② being H, so that it sets the time t1 to 70 ms, and it sets the width of the tag 4 to 10 mm when the tag width signal ① is L with the tag width signal ② being L, so that it sets the time t1 to 100 ms.

The time t2 for reversely rotating the tacking action motor 61 is basically a fixed time for moving the upper edge 81 of the cutting portion 63 to the side of the band tape 52. During this time, the upper edge 81 cuts the band tape 52 to produce the tag 4.

The time t3 from the rise of the front end detecting signal to the termination of the time t2 for reversely rotating the tacking action motor 61 is a time for determining the position for pasting the tag 4 on the sheet 3. The controller 66 determines the time t3 on the basis of the tag pasting position signals ①–④.

The time t4 for forwardly rotating the tacking action motor 61 is a time (basically fixed time) for forwardly rotating a mechanical motor which is required at minimum for carrying out a series of pasting operations by moving the tag pasting belt 56 and transfer roller 59. The time t5 for reversely rotating the tacking action motor 61 is a basically fixed time for moving the upper edge 81 of the cutting portion 63 from the side of the band tape 52 to the original position.

FIG. 16(G) is a diagram showing the variation of a solenoid operating signal outputted from the controller 66 of the sheet sorting apparatus 1 and adapted to control the position of the flapper 44. When the solenoid operating signal is in an on-state, the transfer path of the sheet 3 is switched to the side of the sheet sorting apparatus 1. When the flapper signal shown in FIG. 16(D) is L at the time of fall of the processing demand signal, the controller 66 puts the solenoid operating signal in an on-state for a predetermined period of time in which the sheet 3 is transferred.

As described above, the sheet sorting apparatus 1 draws a predetermined sheet 3 into the interior thereof, pastes a tag 4 of a predetermined width on a predetermined portion of the sheet 3 and discharges the sheet 3 onto a tray 12 for discharged sheet, on the basis of the signals outputted from the printer 2.

Figure 18:
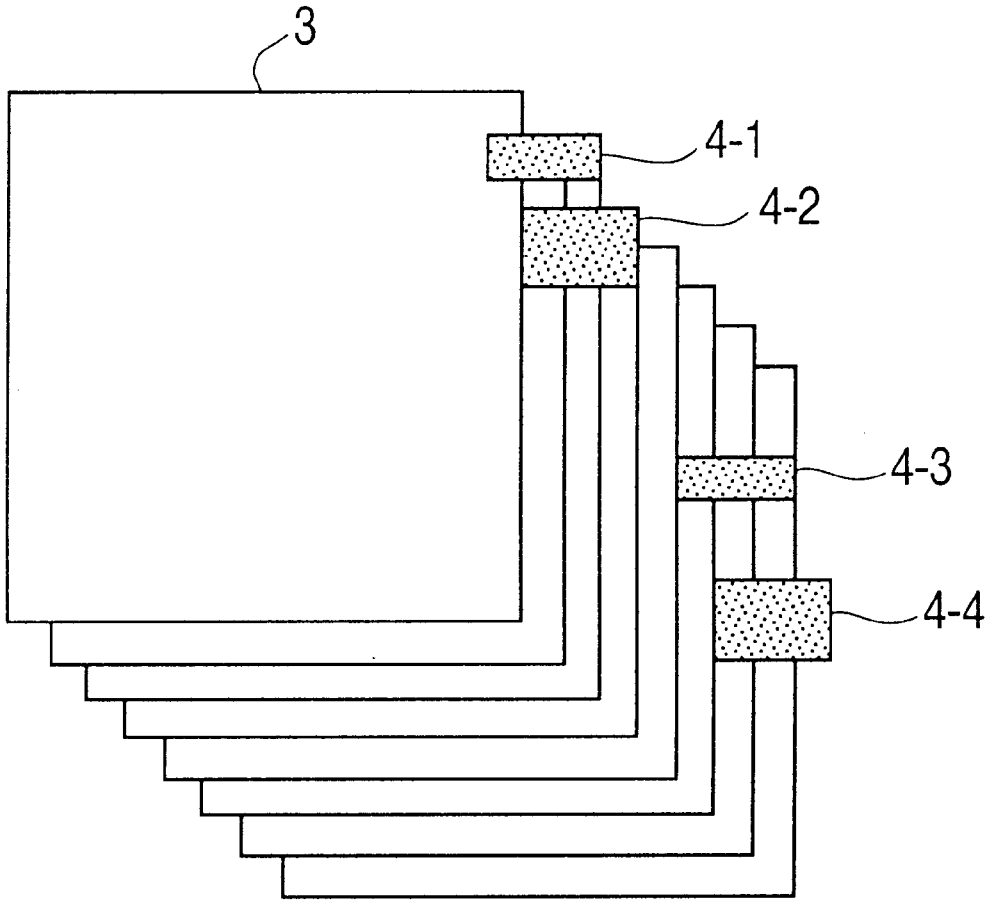
FIG. 18 is a drawing describing sheets 3 stacked on a tray for discharged sheet.

FIG. 18 is a diagram describing sheets 3 having tags 4 pasted thereon, and stacked on the tray 12 for discharged sheet. The tag 4-1 has a width of 5 mm since the number of sheets subjected to a printing job is 1. Similarly, the tag 4-2 has a width of 7 mm since the number of sheets subjected to a printing job is 4, the tag 4-3 has a width of 5 mm since the number of sheets subjected to a printing job is 1, and the tag 4-4 has a width of 7 mm since the number of sheets subjected to a printing job is 2. The tags 4-1 to 4-4 are pasted on the portions designated by the printer 2 of the sheets 3.

Figure 19:
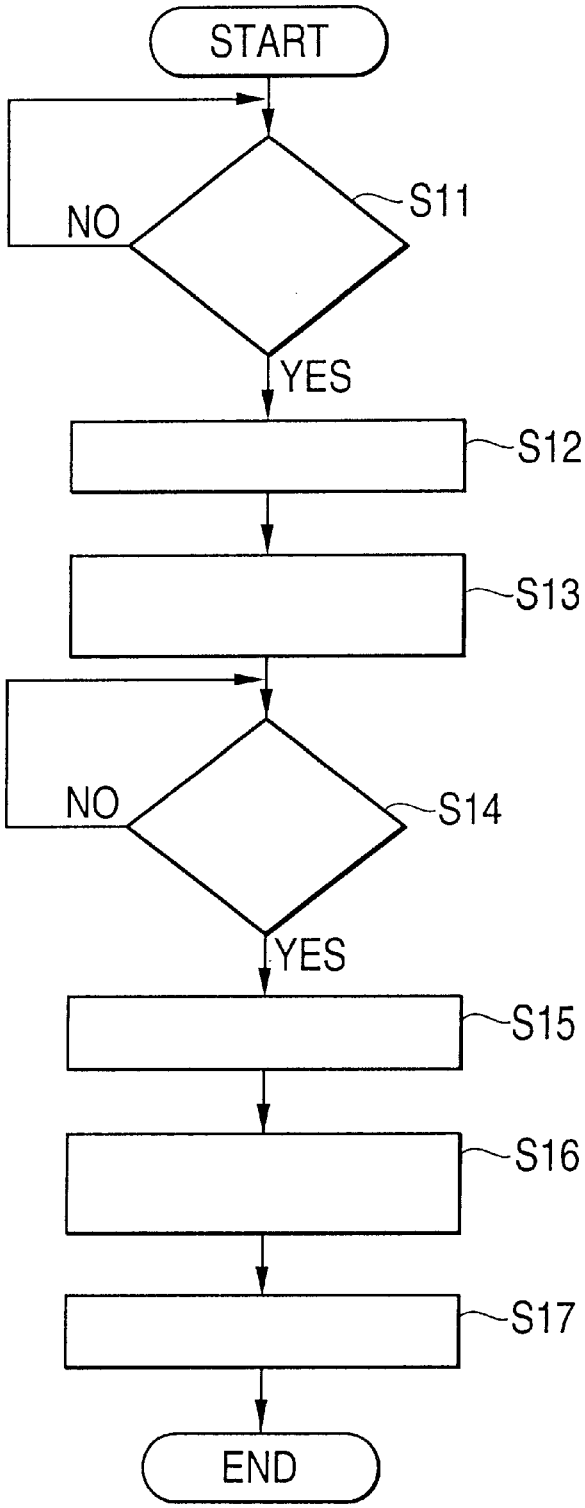
FIG. 19 is a flow chart describing the operation of the sheet sorting apparatus.

FIG. 19 is a flow chart describing the operation of the sheet sorting apparatus 1. In a step S11, the controller 66 of the sheet sorting apparatus 1 judges whether the fall of the processing demand signal is detected or not, and, when a judgment that the fall of the processing demand signal is not detected is given, the procedure returns to the step S11 to repeat the process until the processing command signal has fallen. When a judgment that the fall of the processing demand signal is detected is given in the step S11, the procedure advances to a step S12, and the controller 66 changes the position of the flapper 44 on the basis of a signal from the printer 2. In a step S13, the controller 66 forwardly rotates the tacking action motor 61 to have the draw-out rollers 53, 54 draw out the band tape 52 of a predetermined length.

In a step S14, the controller 66 judges whether the front end detecting signal rises or not, and, when a judgment that the front end detecting signal does not rise is given, the procedure returns to the step S14 and the process is repeated until the front end detecting signal has risen. When a judgment that the front end detecting signal rises is given in the step S14, the procedure advances to a step S15, and the controller 66 reversely rotates the tacking action motor 61 after the lapse of a predetermined period of time based on the signal from the printer 2, to have the cutting portion 63 cut the band tape 52.

In a step S16, the controller 66 forwardly rotates the tacking action motor 61 after the lapse of a predetermined period of time based on the signal from the printer 2, to have the tag pasting belt 56 and transfer roller 59 paste the tag 4 or the sheet 3. In a step S17, the controller 66 reversely rotates the tacking action motor 61 to return the upper edge 81 of the cutting portion 63 to the original position and finish the process.

Thus, the sheet sorting apparatus 1 pastes the tag 4 on the sheet 3.

Figure 20:
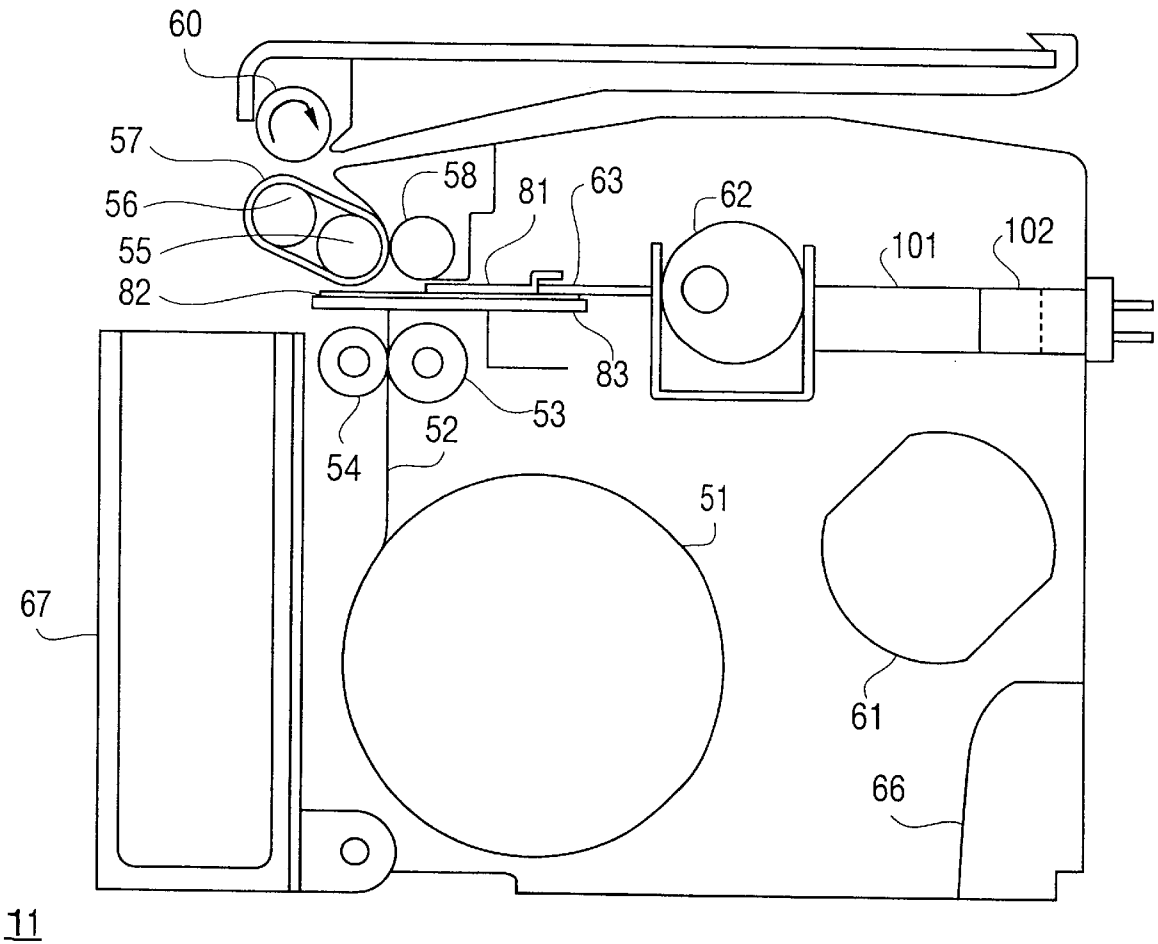
FIG. 20 is a drawing describing another construction of the tag pasting portion.

FIG. 20 is a diagram describing another construction of the tag pasting portion 11. The same reference numerals are added to the parts identical with those shown in FIG. 2, and the descriptions thereof are omitted suitably. The eccentric cam 62 is rotated clockwise in the drawing when the tacking action motor 61 is reversely rotated. When the cutting portion 63 reaches an extreme right position or an extreme left position in the drawing, a stopper (not shown) stops the eccentric cam 62. Namely, even when the tacking action motor 61 is reversely rotated for a period of time longer than a predetermined period of time, the cutting portion 63 stops in the extreme right position or the extreme left position in the drawing. When the tacking action motor 61 is forwardly rotated, the stoppage of the eccentric cam 62 is ceased.

A light intercepting plate 101 is fixed to the cutting portion 63, and moved in the lateral direction of the drawing in accordance with a movement of the cutting portion 63. A sensor 102 is a photoelectric switch adapted to output a signal corresponding to the movement of the light intercepting plate 101, i.e. the movement of the cutting portion 63.

Figure 21A:
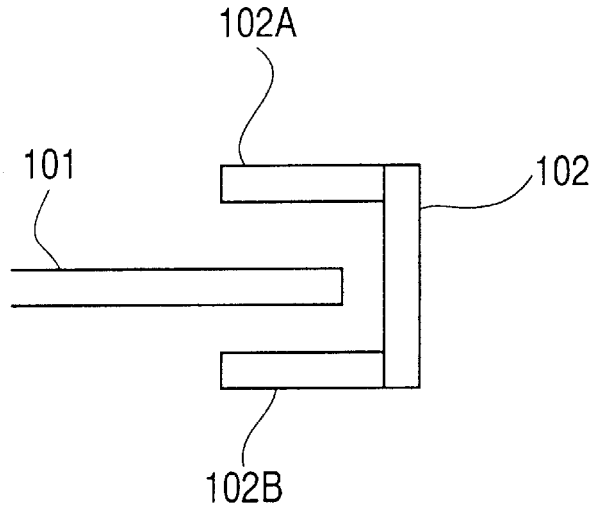
FIGS. 21(A) and 21(B) are drawings describing the operations of a light intercepting plate and a sensor.

FIG. 21 is a diagram describing operations of the light intercepting plate 101 and the sensor 102. A light-emitting portion 102A of the sensor 102 emits predetermined light toward a light receiving portion 102B, and the light receiving portion 102B receives the light emitted by the light-emitting portion 102A. FIG. 21(A) is a diagram showing the positional relation between the light intercepting plate 101 and sensor 102 when the cutting portion 63 is moved rightward in FIG. 20, i.e., when the tag pasting portion 11 is in an initial condition . When the light intercepting plate 101 screens the light emitted by the light emitted portion 102A, i.e., when the light receiving portion 102B does not receive the light emitted by the light-emitting portion 102A, the sensor 102 supplies a predetermined signal to the controller 66. The condition in which the sensor 102 outputs a predetermined signal will hereinafter be referred to as the condition in which the sensor 102 is on.

Figure 21B:
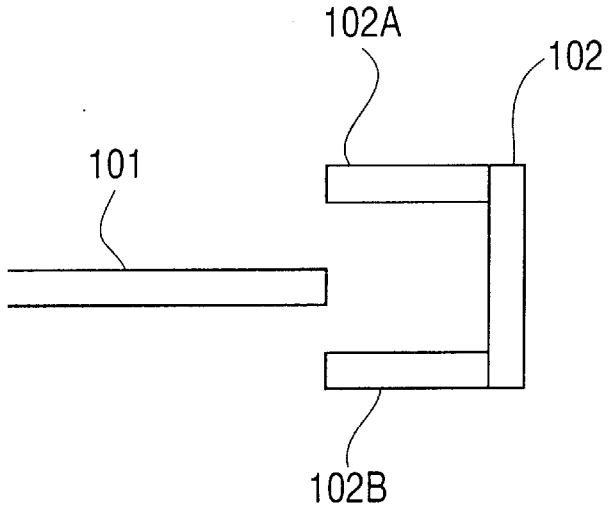

FIG. 21(B) is a diagram showing the positional relation between the light intercepting plate 101 and the sensor 102 with the cutting portion 63 moving leftward in FIG. 20, i.e., with the upper edge 81 cutting the band tape 52. As shown in FIG. 21(B), the light intercepting plate 101 does not screen the light emitted by the light-emitting portion 102A and the light receiving portion 102B receives the light emitted by the light-emitting portion 102A, the sensor 102 supplying an other signal to the controller 66. The condition in which the sensor 102 outputs the other signal will hereinafter be referred to as the condition in which the sensor 102 is off.

Thus, the sensor 102 of the tag pasting portion 11 shown in FIG. 20 outputs a signal which corresponds to the position of the cutting portion 63 to the controller 66.

Figure 22:
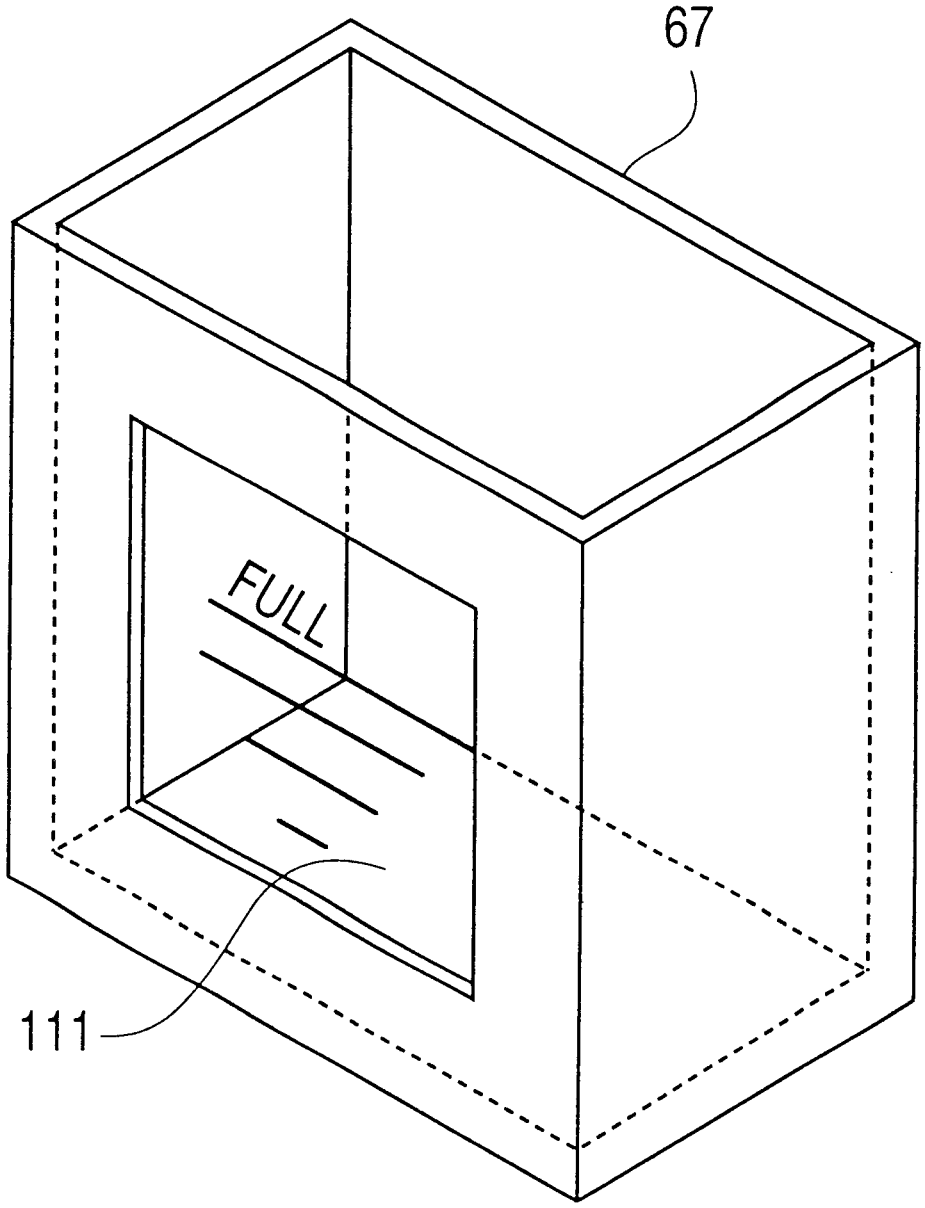
FIG. 22 is a drawing describing the construction of a storage box of the tag pasting portion shown in FIG. 20.

FIG. 22 is a diagram describing the construction of the storage box 67 of the tag pasting portion 11 shown in FIG. 20. The storage box 67 of the tag pasting portion 11 shown in FIG. 20 has a window 111 formed of & transparent plastic or glass. A user can see an amount of tags 4 which are stored in the storage box 67 (not pasted on sheets 3), through the window 111.

Figure 23:
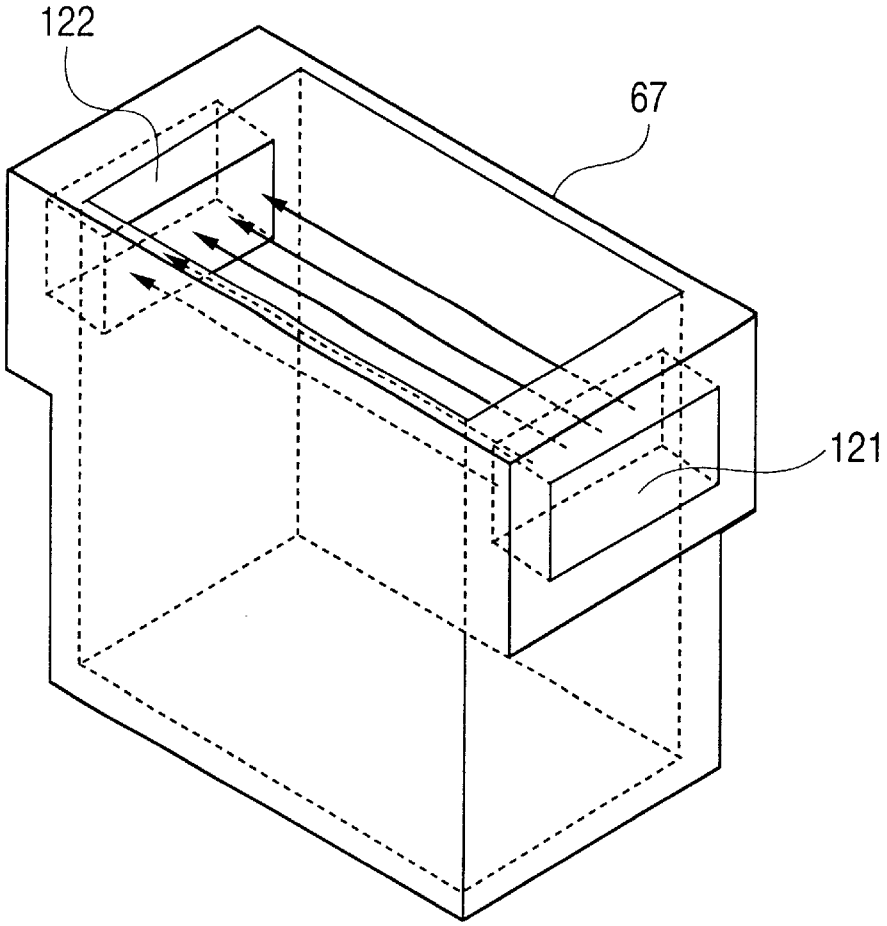
FIG. 23 is a drawing describing another construction of the storage box of the tag pasting portion shown in FIG. 20.

FIG. 23 is a diagram describing another construction of the storage box 67 of the tag pasting portion 11 shown in FIG. 20. A light-emitting portion 121 emits predetermined light toward a light receiving portion 122. The light receiving portion 122 outputs a predetermined signal to the controller 66 when it receives the light emitted by the light-emitting portion 121, i.e., when less than a predetermined amount of tags 4 are stored in the storage box 67, and an other signal to the controller 66 when the light receiving portion 122 does not receive the light emitted by the light-emitting portion 121, i.e., when not less than a predetermined amount of tags 4 are stored in the storage box 67.

Thus, the light receiving portion 122 outputs a signal corresponding to the amount of the tags 4 stored in the storage box 67 to the controller 66. The sheet sorting apparatus 1 can make a display or an action (for example, stop the operation of the sheet sorting apparatus 1 when more than a predetermined amount of tags 4 are stored in the storage box 67) corresponding to the amount of the tags 4 stored in the storage box 67.

Figure 24:
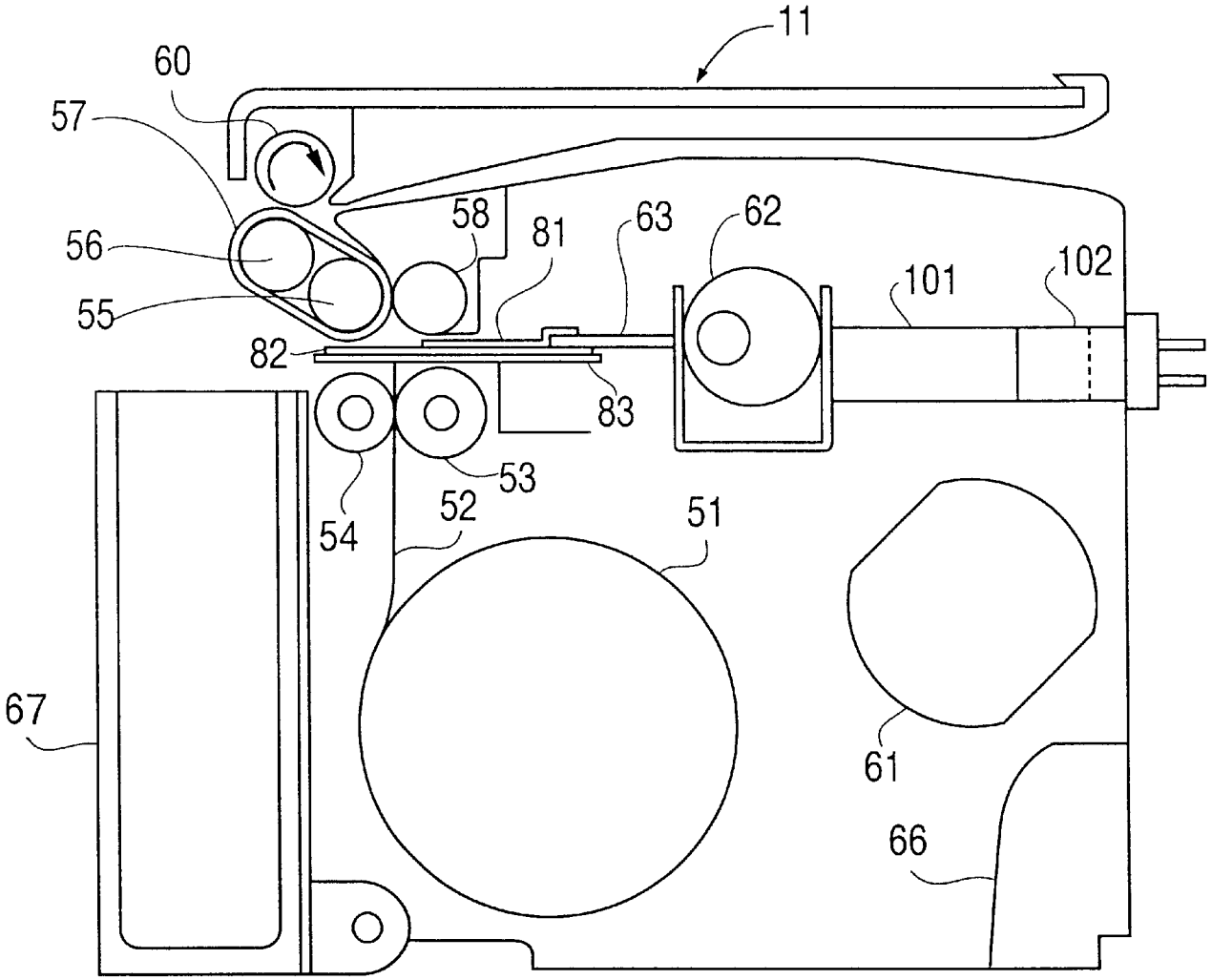
FIG. 24 is a drawing describing an operation of the tag pasting portion shown in FIG. 20.

The operation of the tag pasting portion 11 shown in FIG. 20 will now be described. FIG. 24 is a diagram describing an initial condition of the tag pasting portion 11, the operation of which has not yet been started. The tacking action motor 61 is stopped, and the cutting portion 63 is moved to a predetermined extreme right side position in the drawing. The transfer roller 60 to which the driving force of the sheet discharge roller 16 of the printer 2 is transmitted is rotated clockwise in the drawing. Since the cutting portion 63 is positioned on the right side in the drawing, the light intercepting plate 101 screens the light emitted by the light-emitting portion 102A of the sensor 102, so the sensor 102 is turned on.

Figure 25:
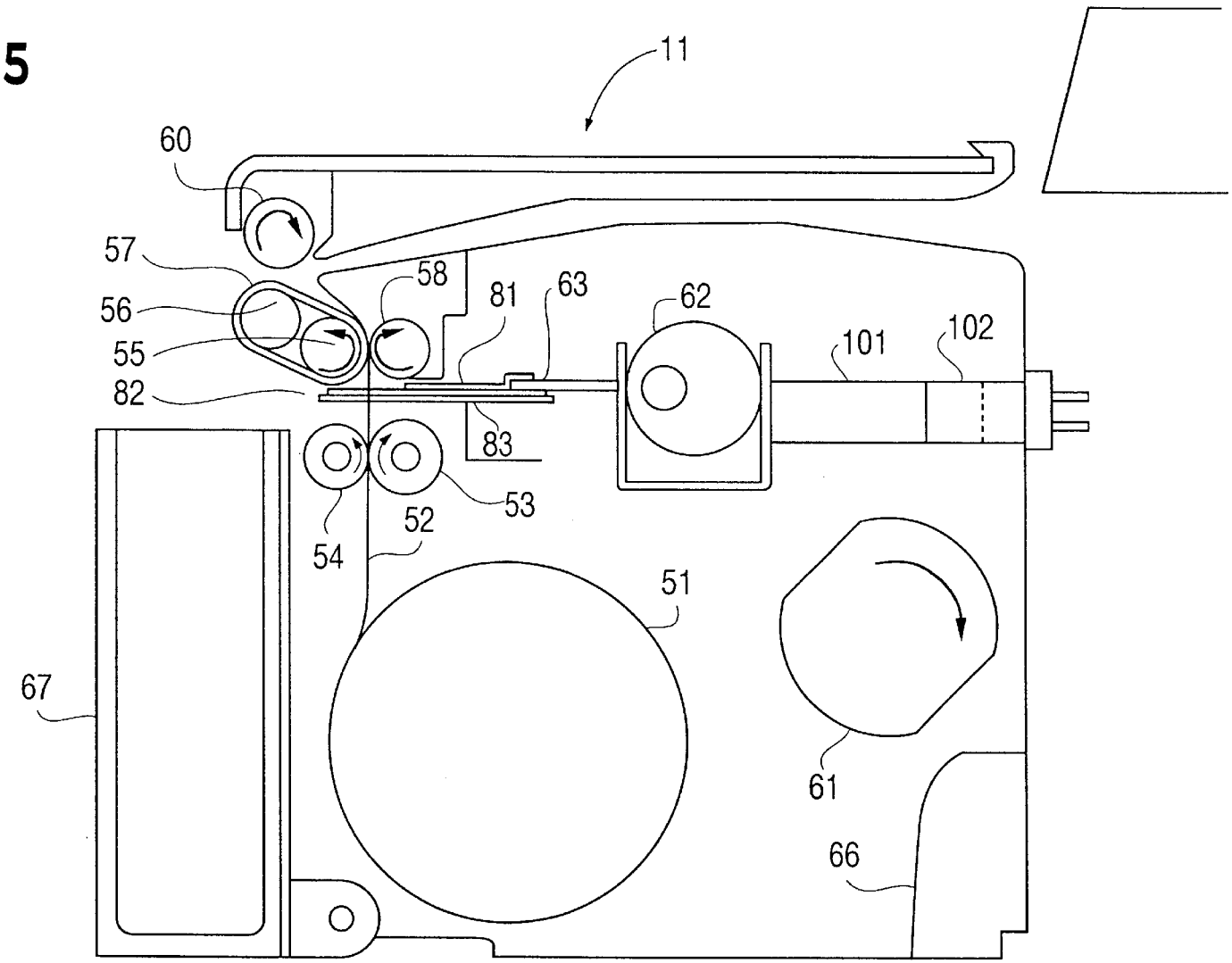
FIG. 25 is a drawing describing the operation of the tag pasting portion shown in FIG. 20.

FIG. 25 is a diagram describing the condition of the tag pasting portion 11 corresponding to time t11 of FIG. 30 which will be described later. The tacking action motor 61 is forwardly rotated, and the draw-out rollers 53, 54, and the guide roller 58 and tag pasting belt 57 are rotated, the band tape 52 corresponding to the length of the time t11 being drawn out from the sheet roll 51 in the upward direction of the drawing. The cutting portion 63 is not moved even when the tacking action motor 61 is forwardly rotated, so that the sensor 102 continues to be on.

Figure 26:
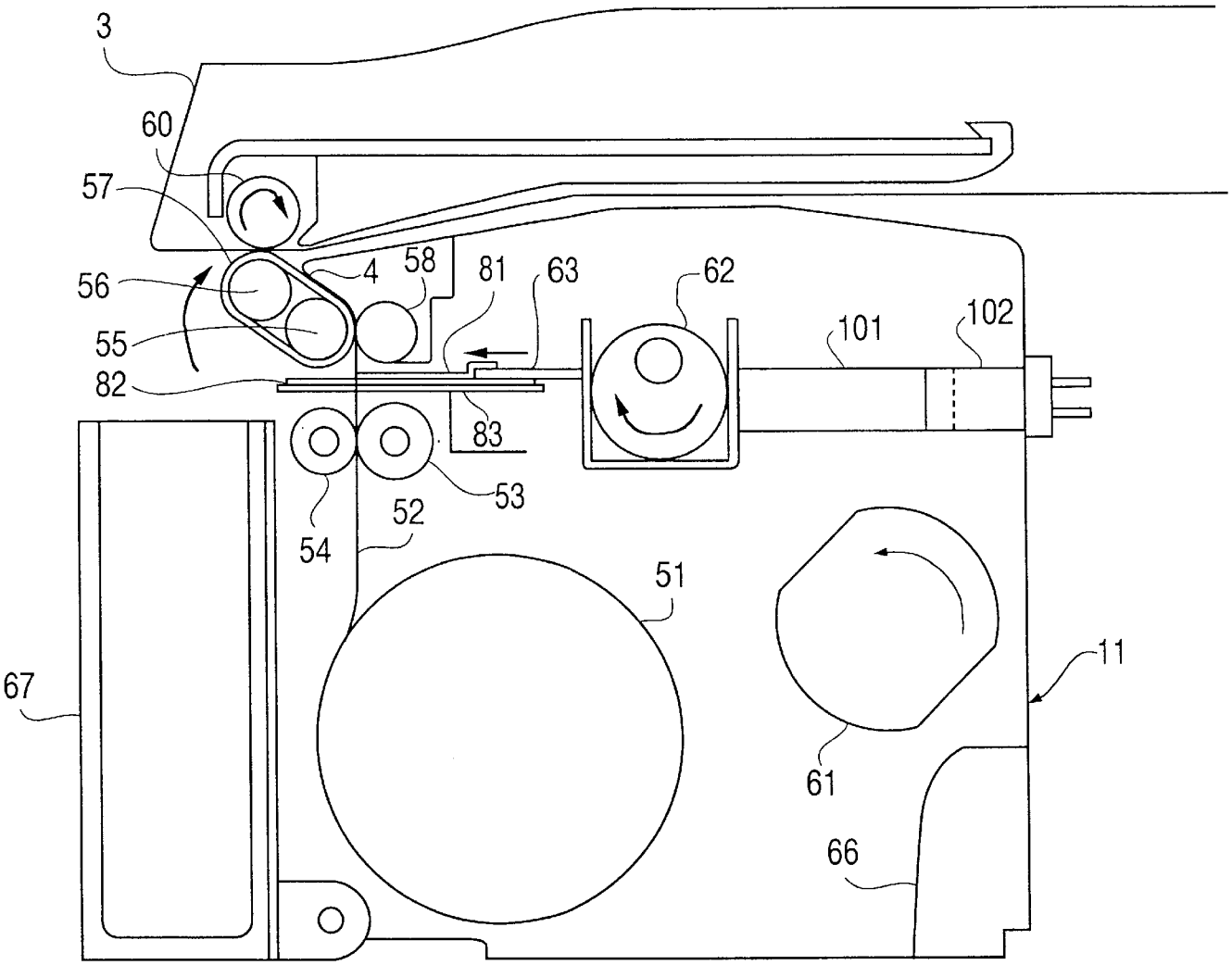
FIG. 26 is a drawing describing the operation of the tag pasting portion shown in FIG. 20.
Figure 30:
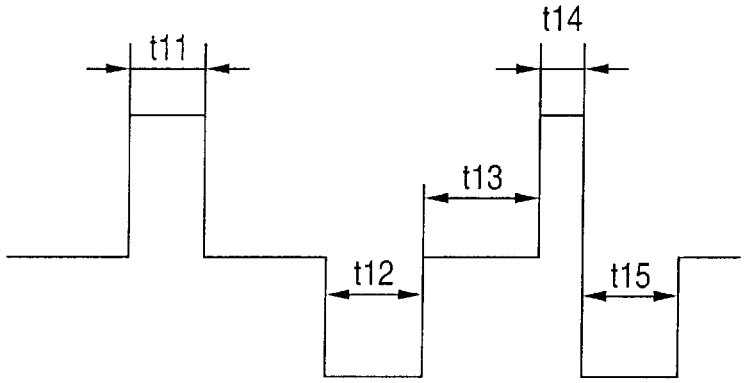
FIG. 30 is a time char t describing a mot or operation signal for the tag pasting portion shown in FIG. 20.

FIG. 26 is a diagram describing the condition of the tag pasting portion 11 corresponding to time t12 of FIG. 30. The tacking action motor 61 is reversely rotated to cause the eccentric cam 62 to be rotated clockwise in the drawing, and the cutting portion 63 to be moved leftward in the drawing. Since the cutting portion 63 is moved leftward in the drawing, the sensor 102 changes from an on-state to an off-state.

The band tape 52 of a predetermined length held between the draw-out rollers 53, 54, and the guide roller 58 and tag pasting belt 57 is cut with the upper edge 81 of the cutting portion 63 to produce a tag 4 of a predetermined length. The driving pulley 55 and driven pulley 56 are generally rotated clockwise in the drawing around the driving pulley 55 to bring the belt 57 in contact with the transfer roller 60.

Figure 27:
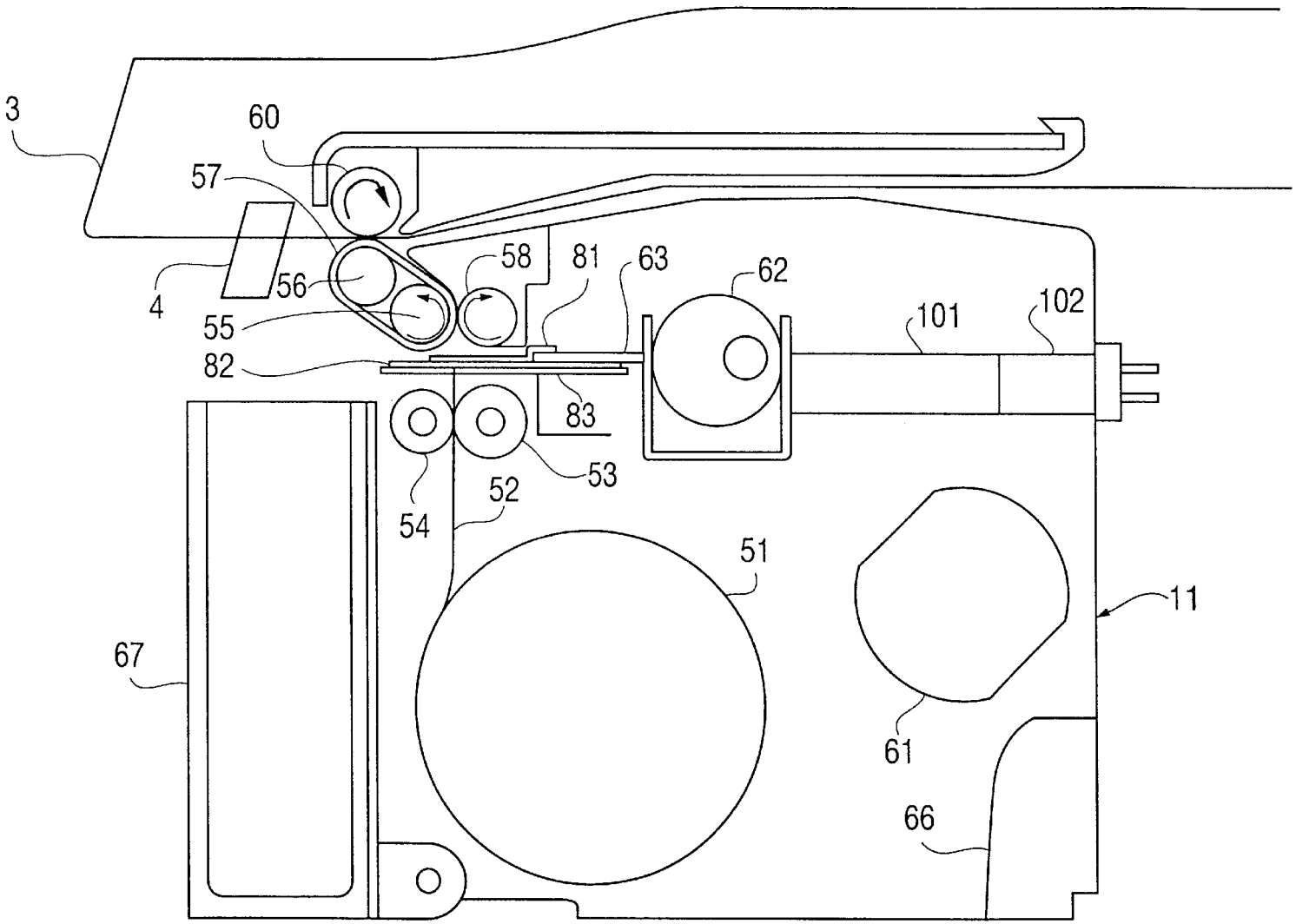
FIG. 27 is a drawing describing the operation of the tag pasting portion shown in FIG. 20.

FIG. 27 is a diagram describing the condition of the tag pasting portion 11 corresponding to time t13 of FIG. 30 which will be described later. The tacking action motor 61 is stopped at a predetermined time, and the turning of the tag pasting belt 57, driving pulley 55 and driven pulley 56 is stopped in a predetermined position in which the tag pasting belt 57 is pressed by the transfer roller 60. The tag 4 is transferred with the sheet 3 as it is pressed at a predetermined pressure by the transfer roller 60 and tag pasting belt 57, and pasted on the sheet 3.

Since the cutting portion 63 is positioned on a left side portion of the drawing, the light intercepting plate 101 does not screen the light emitted by the light-emitting portion 102A of the sensor 102, so that the sensor 102 is off.

Figure 28:
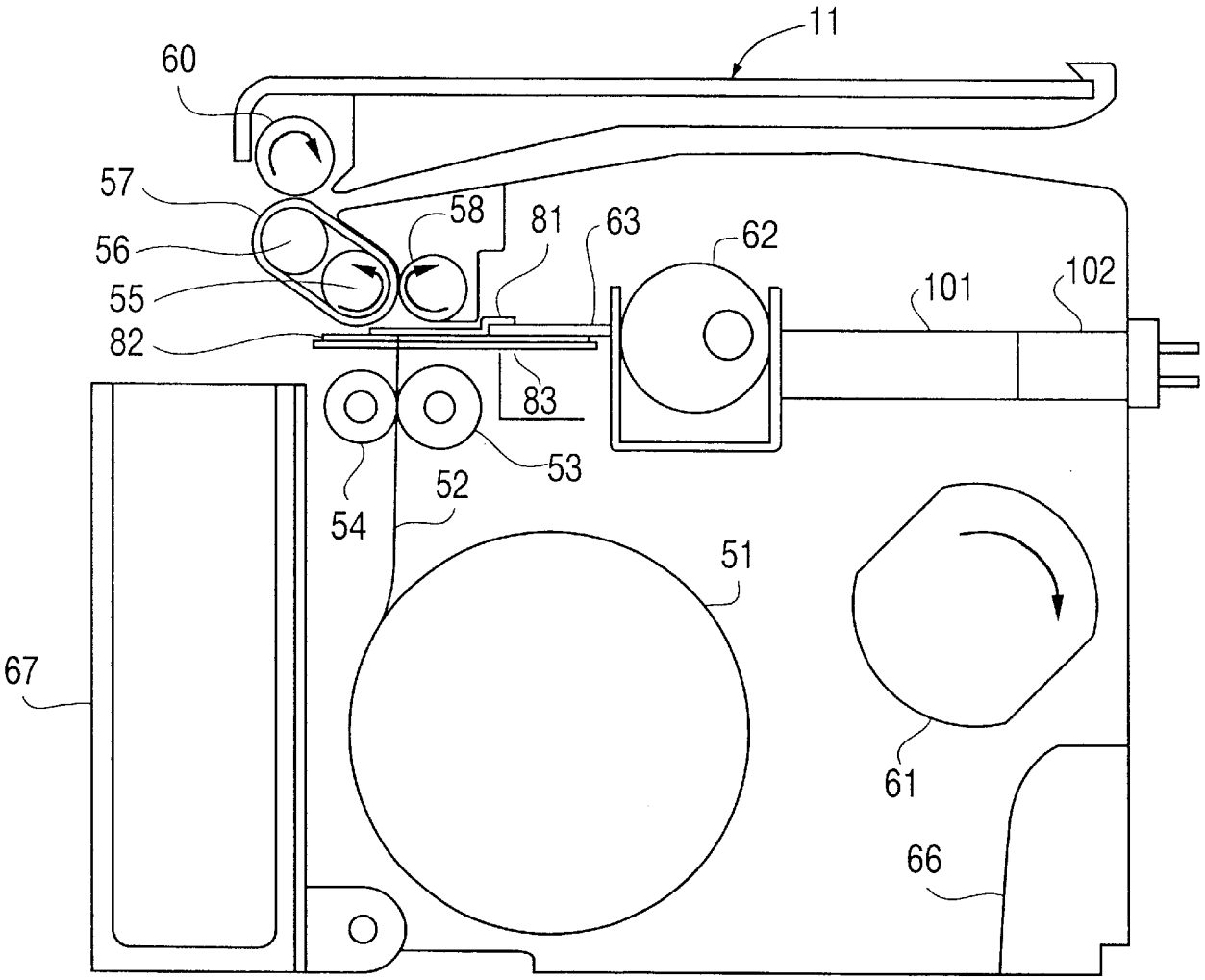
FIG. 28 is a drawing describing the operation of the tag pasting portion shown in FIG. 20.

FIG. 28 is a diagram describing the condition of the tag pasting portion 11 corresponding to time t15 of FIG. 30 which will be described later. The tacking action motor 61 is forwardly rotated, and the stoppage of the eccentric cam 62 is ceased. Even when the tacking action motor 61 is forwardly rotated, the cutting portion 63 is not moved, so that the sensor 102 continues to be off.

Figure 29:
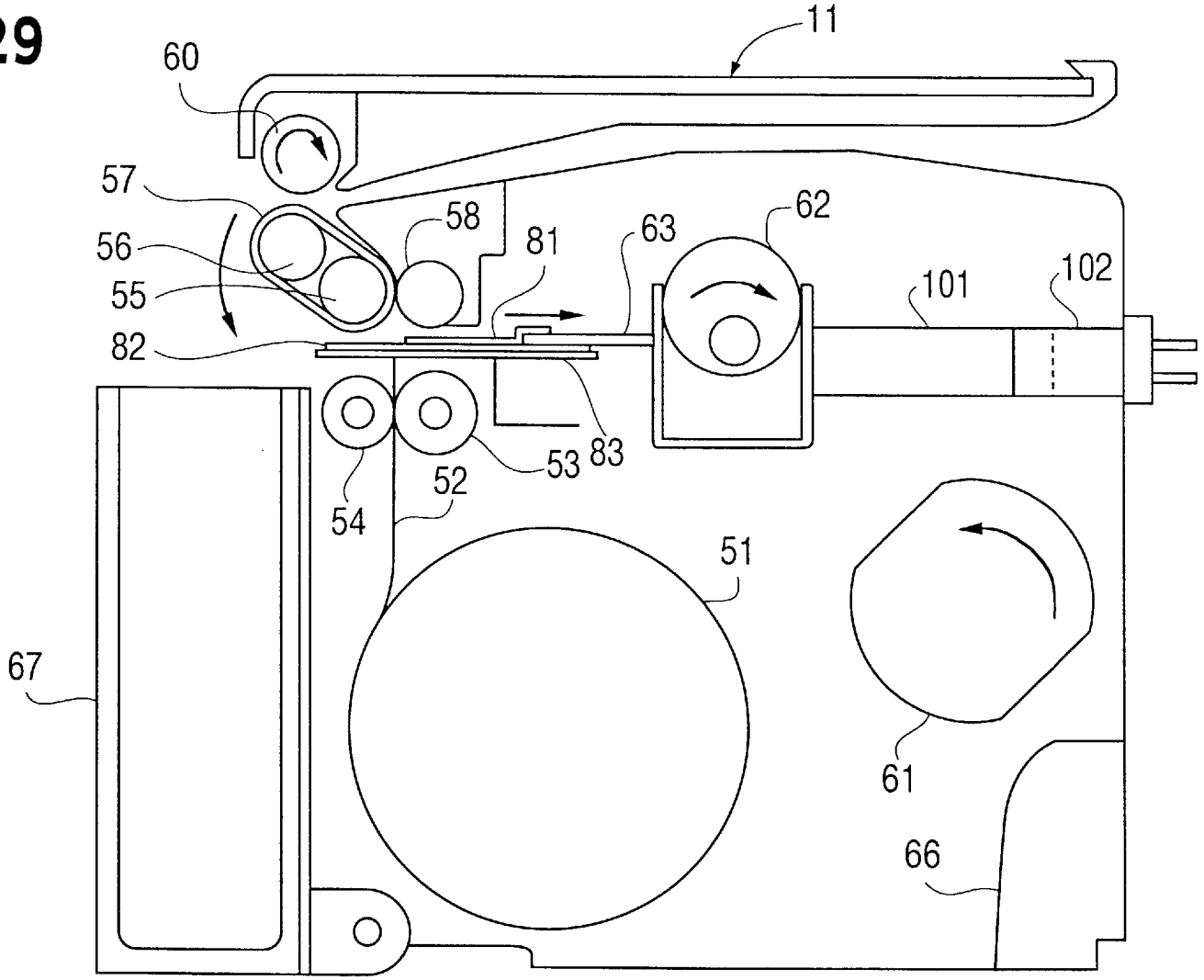
FIG. 29 is a drawing describing the operation of the tag pasting portion shown in FIG. 20.

FIG. 29 is a diagram describing the condition of the tag pasting portion 11 corresponding to time t15 of FIG. 30 which will be described later. The tacking action motor 61 is reversely rotated to cause the eccentric cam 62 to be rotated clockwise in the drawing, and the cutting portion 63 to be moved rightward in the drawing. Since the cutting portion 63 is moved rightward in the drawing, the sensor 102 changes from an off-state to an on-state.

As described above, the tag pasting portion 11 is put in the conditions shown in FIGS. 24–29, in order repeatedly to paste the tag 4 of a predetermined length on a predetermined portion of the sheet 3.

The variation of the motor operating signal supplied to the tacking action motor 61 when the tag pasting portion 11 shown in FIG. 20 performs the operations described in FIGS. 24–29 will now be described with reference to a time chart of FIG. 30. The time t11 for forwardly rotating the tacking action motor 61 is a time in which the draw-out rollers 53, 54 draw out the band tape 52 as in the time t1 of FIG. 16(F), and the length thereof determines the width of the tag 4. The time t12 for reversely rotating the tacking action motor 61 is basically a time of a fixed length in which the upper edge 81 of the cutting portion 63 is moved toward the band tape 52 as in the time t2 of FIG. 16(F). During this time t12, the upper edge 81 cuts the band tape 52 to produce the tag 4. At the same time as the tag 4 is cut off, it is pasted on the sheet 3 by the belt 57 and roller 60.

The time t13 for stopping the tacking action motor 61 may not be provided. When the time t13 is not provided, the tag pasting portion 11 is put in the condition shown in FIG. 27 for the time t14, and skips the condition corresponding to that of FIG. 28. The time t14 for forwardly rotating the tacking action motor 61 is the time for ceasing the stoppage of the eccentric cam 62. The time t15 for reversely rotating the tacking action motor 61 is a time, the length of which is equal to the time t12, for moving the upper edge 81 of the cutting portion 63 from the side of the band tape 52 to the original position.

Figure 31A:
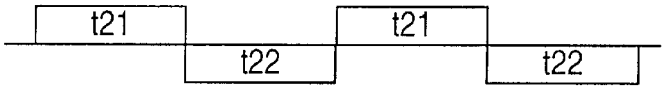
FIG. 31 is a time chart describing motor operating signals generated when the tag pasting portion is returned to an initial condition.

A process for returning the tag pasting portion 11 of FIG. 20 to the initial condition when the operation thereof is stopped halfway will now be described. When the tag pasting portion 11 in the condition shown in FIG. 26 is stopped with the sensor 102 turned off, the controller 66 outputs a motor operating signal shown in FIG. 31(A). Namely, the controller 66 rotates the tacking action motor 61 forward for a predetermined period of time t21, and reversely for a predetermined period of time t22, and further forward for a predetermined period of time t21, and reversely for a predetermined period of time t22.

Owing to the forward rotation of the tacking action motor 61 during the first time t21 and the reverse rotation thereof during the first time t22, the eccentric cam 62 is turned until it has been stopped by a stopper, and the tag pasting portion 11 is put in the condition shown an FIG. 27. Owing to the forward rotation of the tacking action motor 61 during the second time t21 and the reverse rotation thereof during the second time t22, the tag pasting portion 11 returns to the initial condition shown in FIG. 24 via the condition shown in FIG. 28 and the condition shown in FIG. 29.

Figure 31B:
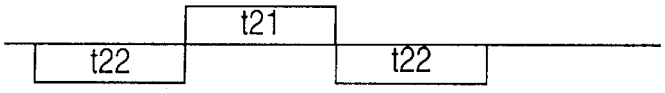

When the tag pasting portion 11 is stopped (the sensor 102 is on) in the condition shown in FIG. 25, or in the condition shown in FIG. 26 with the sensor 102 on, the controller 66 outputs the motor operating signal shown in FIG. 31(B). Namely, the controller 66 rotates the tacking action motor 61 reversely for a predetermined period of time t22, forward for a predetermined period of time t21, and reversely for a predetermined period of time t22.

Owing to the reverse rotation of the tacking action motor 61 during the first time t22, the eccentric cam 62 is rotated until it has been stopped by the stopper, and the tag pasting portion 11 is put in the condition shown an FIG. 27. Owing to the subsequent forward rotation of the tacking action motor 61 during the time t21 and reverse rotation thereof during the time t22, the tag pasting portion 11 returns to the initial condition shown in FIG. 24 via the condition shown in FIG. 28 and the condition shown in FIG. 29.

Figure 31C:
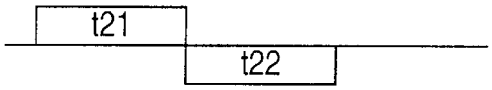

When the tag pasting portion 11 is stopped in the condition shown in FIG. 27 (the sensor 102 is off), and in the condition shown in FIG. 28 (the sensor 102 is off), or in the condition shown in FIG. 29 with the sensor 102 off, the controller 66 outputs the motor operating signal shown in FIG. 31(C). Namely, the controller 66 rotates the tacking action motor 61 forward for a predetermined period of time t21, and reversely for a predetermined period of time t22.

Owing to the forward rotation of the tacking action motor 61 during the first time t21, the stoppage of the eccentric cam 62 is ceased. Owing to the reverse rotation of the tacking action motor 61 during the later time t22, the cutting portion 63 is moved to an extreme right side in FIG. 20 until the eccentric cam 62 has been stopped by the stopper, and the tag pasting portion 11 returns to the initial condition shown in FIG. 24.

Figure 31D:
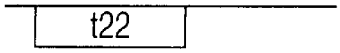

When the tag pasting portion 11 is stopped in the condition shown in FIG. 24 (the sensor 102 is on), or it is stopped in the condition shown in FIG. 29 with the sensor 102 on, the controller 66 outputs the motor operating signal shown in FIG. 31(D). Namely, the controller 66 reversely rotates the tacking action rotor 61 for a predetermined period of time t22. Owing to the reverse rotation of the tacking action motor 61 during the time t22, the cutting portion 63 is moved to the extreme right side in FIG. 20, and the eccentric cam 62 is stopped by the stopper, the tag pasting portion 11 returning to the initial condition shown in FIG. 24.

Figure 32:
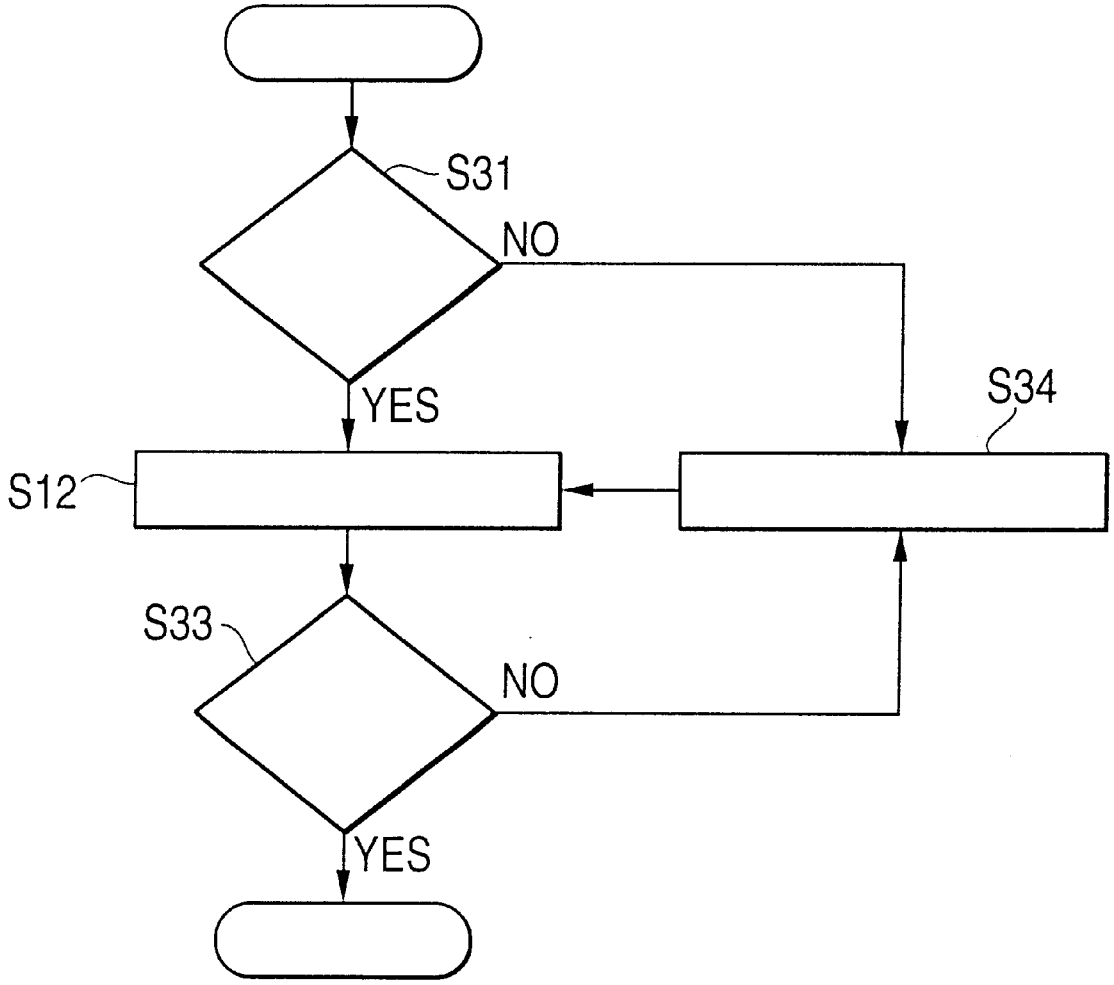
FIG. 32 is a flow chart describing a process for the returning of the tag pasting portion.

A process for returning the tag pasting portion 11 will now be described with reference to a flow chart of FIG. 32. In a step S31, the controller 66 judges whether the sensor 102 is on or not, and, when a judgment that the sensor 102 is on is given, the procedure advances to a step S32 to reversely rotate the tacking action motor 61 for a period of time t22. In a step S33, the controller 66 judges whether the sensor 102 is on or not, and, when a judgment that the sensor 102 is on is given, the process is finished.

When a judgment that the sensor 102 is off is given in the step S31 or a judgment that the sensor 102 is off is given in the step S33, the procedure advances to a step S34, and the controller 66 forwardly rotates the tacking action motor 61 for the time t21, and the procedure advances to the step S32.

As described above, even when the tag pasting portion 11 is stopped in any condition on the basis of only the output from the sensor 102, the tag pasting portion 11 can be returned simply to the initial condition.

Figure 33:
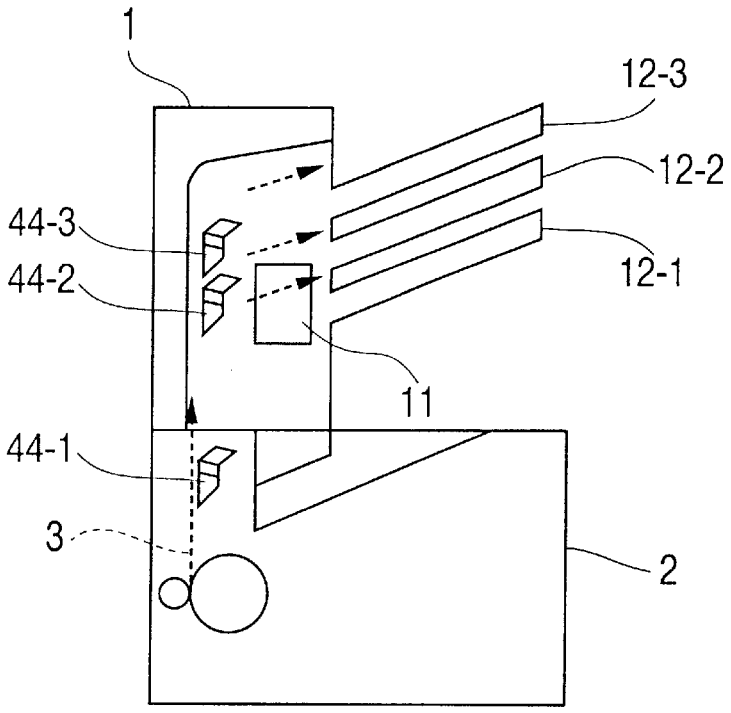
FIG. 33 is a drawing showing the construction of another mode of embodiment of the sheet sorting apparatus.
Figure 34:
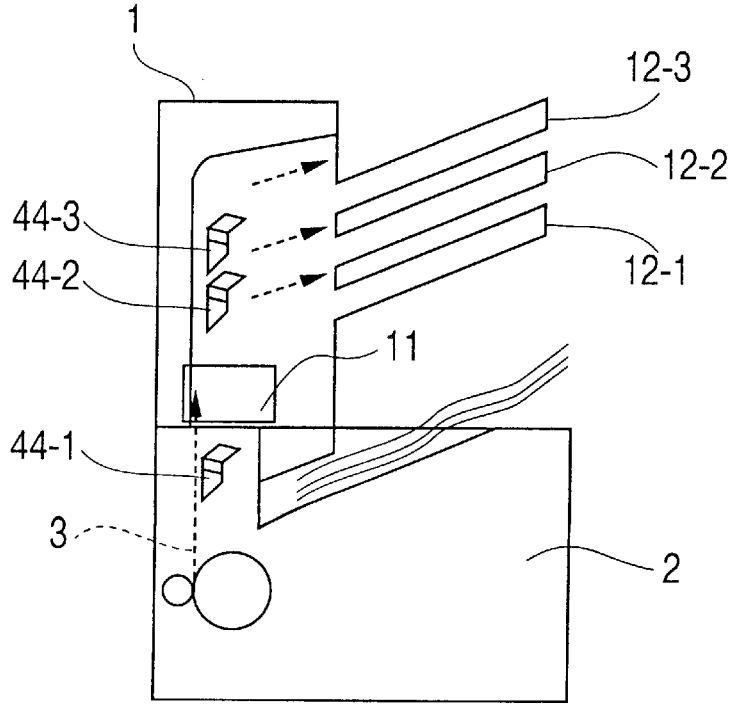
FIG. 34 is a drawing showing the construction of still another mode of embodiment of the sheet sorting apparatus.

FIGS. 33 and 34 are diagrams showing the construction of other modes of embodiments of the sheet sorting apparatus 1. The sheet sorting apparatus 1 of FIG. 33 has a plurality of trays 12-1 to 12-3 and a plurality of flappers 44-1 to 44-3, and a tag pasting portion 11 pastes a tag 4 on a sheet 3 discharged onto the tray 12-1. The sheet sorting apparatus 1 of FIG. 34 also has a plurality of trays 12-1 to 12-3 and a plurality of flappers 44-1 to 44-3, and the tag pasting portion 11 pastes tags 4 on sheets discharged onto the trays 12-1 to 12-3. When the pasting of tags 4 on sheets by the tag pasting portion 11 enables the sheets to be classified into eight kinds of sheets, the sheet sorting apparatus 1 and printer 2 of FIG. 33 are capable of sorting sheets into eleven kinds of sheets. When the same tag pasting portion 11 is used, the sheet sorting apparatus 1 and printer 2 of FIG. 34 are capable of sorting sheets into twenty-five kinds of sheets. Thus, the structures of the modes of embodiments of FIGS. 33 and 34 are suitable to sort sheets 3 into a multiplicity of kinds of sheets.

In this specification, embodiments in which the width of the tags 4 is varied depending upon the number of sheets subjected to a printing job of the printer 2 are described. The width of the tags 4 may also be varied by sending to the sheet sorting apparatus 1 signals according to the quality (for example, high-quality sheet, regenerated sheet and coated sheet) of the sheets 3.

According to the sheet sorting apparatus defined in claim 1, the change-over portion switches a path, in which a sheet is transferred to either a first path in which a tag is pasted on the sheet or a second path in which a tag is not pasted thereon, the draw-out portion draws out a band tape coated at one side edge portion thereof with a pressure sensitive adhesive, the cutting portion prepares the tag by cutting a predetermined portion of the band tape, the pasting portion introduces the prepared tag to a predetermined position with respect to the sheet, holds the tag from both sides thereof with a part thereof superposed on the sheet and pasting the tag on the sheet, the receiving portion receives the sheet on which the tag is pasted by the pasting portion, and the control portion controls the movements of the change-over portion, draw-out portion and cutting portion. Therefore, the sheets can be classified easily and reliably.

While preferred embodiments have been described herein, modification of the described embodiments may become apparent to those of ordinary skill in the art, following the teachings of the invention, without departing from the spirit and scope of the invention as set forth in the appended claims.

What is claimed is:

1. A sheet sorting apparatus installed on an image processing apparatus to paste a tag on a predetermined sheet discharged from said image processing apparatus, comprising:

a change-over assembly for switching a path, in which said sheet is transferred to either a first path in which said tag is pasted on said sheet or a second path in which said tag is not pasted on said sheet, a draw-out assembly for drawing out a band tape coated at one side edge portion thereof with a pressure sensitive adhesive, a cutting assembly for preparing said tag by cutting said band tape at a predetermined portion thereof, a pasting assembly for introducing said prepared tag to a predetermined position with respect to said sheet and pasting said tag on said sheet, a receiving assembly for receiving said sheet on which said tag is pasted said pasting assembly, and a control assembly for controlling movements of said change-over assembly, said draw-out assembly and said cutting assembly.

2. A sheet sorting apparatus according to claim 1, wherein said draw-out assembly and said cutting assembly are driven by the same motor.

3. A sheet sorting apparatus according to claim 1, wherein said pasting assembly holds said tag from both sides thereof with a part thereof superposed on said sheet.

4. A sheet sorting apparatus according to claim 1, wherein said sorting apparatus further comprises a structure for transferring the sheet by utilizing a driving force of said image processing apparatus.

5. A sheet sorting apparatus according to claim 4, wherein said draw-out assembly and said cutting assembly are driven by the same motor.

6. A sheet sorting apparatus according to claim 4, wherein said control assembly varies a width of said tag by controlling a movement of said cutting assembly.

7. A sheet sorting apparatus according to claim 6, wherein said width of said tag is varied according to number of other sheets in a set represented by said sheet with said tag pasted thereon.

8. A sheet sorting apparatus according to claim 1, wherein said control assembly varies a width of said tag by controlling a movement of said cutting assembly.

9. A sheet sorting apparatus according to claim 8, wherein said width of said tag is varied according to number of other sheets in a set represented by said sheet with said tag pasted thereon.

10. A sheet sorting apparatus according to claim 8, wherein said draw-out assembly and said cutting assembly are driven by the same motor.

11. A sheet sorting apparatus according to claim 1, wherein said sorting apparatus further comprises a detecting assembly for detecting the position of said cutting assembly.

12. A sheet sorting apparatus according to claim 11, wherein said detecting assembly transmits a different signal to said control assembly recording to a detected position of said cutting assembly.

13. A sheet sorting apparatus according to claim 1, wherein said sorting apparatus further comprises a storage assembly for storing a tag not pasted on said sheet.

14. A sheet sorting apparatus according to claim 13, wherein said sorting apparatus further comprises a storage detecting assembly for detecting an amount of said tags stored in said storage assembly.

15. A sheet sorting apparatus according to claim 1, wherein said band tape is drawn from a sheet roll, said sheet roll installed in a roll case.

16. A sheet sorting apparatus according to claim 15, wherein said roll case comprises a first, second and third section, and wherein said sheet roll is installed in said roll case by inserting a shaft of said first section into said sheet roll, bending said first section with respect to said second section, and bending said third section with respect to said second section, whereby said third section is engaged by said shaft of said first section.

17. A sheet sorting apparatus according to claim 1, wherein said cutting portion comprises a cutting edge overlaying a first fixed surface, said fixed surface having a first portion forming a reduced contact area in slidable contact with said cutting edge and a second portion avoiding contact with said cutting edge.

18. A sheet sorting apparatus according to claim 17, wherein said cutting portion further comprises a second fixed surface upon which said first fixed surface is mounted, said second fixed surface at least partially extending said second portion away from said cutting edge.

19. A sheet sorting apparatus for pasting a tag on a predetermined sheet discharged from an image processing apparatus, comprising:

a flapper for selecting from either a first path in which said tag is pasted on said sheet or a second path, draw-out rollers for drawing out a band tape, a cutting portion for cutting said band tape and producing said tag, and a pasting portion for pasting said tag on said sheet.

20. The sheet sorting apparatus according to claim 19, further comprising at least one receiving tray for receiving said sheet.

21. The sheet sorting apparatus according to claim 19, wherein said band tape is coated at one side edge with an adhesive.

22. The sheet sorting apparatus according to claim 19, wherein said sheet sorting apparatus utilizes a driving force of said image processing apparatus.

23. The sheet sorting apparatus according to claim 19, further comprising a detector for detecting the position of said cutting portion.

24. The sheet sorting apparatus according to claim 19, further comprising a controller for controlling movements of said flapper, said draw-out rollers and said cutting portion.

25. The sheet sorting apparatus according to claim 24, wherein said band tape is coated at one side edge with an adhesive.

26. The sheet sorting apparatus according to claim 24, wherein said sheet sorting apparatus utilizes a driving force of said image processing apparatus.

27. The sheet sorting apparatus according to claim 24, wherein said controller varies a width of said tag by controlling a movement of said cutting portion.

28. The sheet sorting apparatus according to claim 24, further comprising a detector for detecting the position of said cutting portion.

29. A sheet sorting apparatus according to claim 19, wherein said band tape is drawn from a sheet roll, said sheet roll installed in a roll case.

30. A sheet sorting apparatus according to claim 29, wherein said roll case comprises a first, second and third section, and wherein said sheet roll is installed in said roll case by inserting a shaft of said first section into said sheet roll, bending said first section with respect to said second section, and bending said third section with respect to said second section, whereby said third section is engaged by said shaft of said first section.

31. A sheet sorting apparatus according to claim 19, wherein said cutting portion comprises a cutting edge overlaying a first fixed surface, said fixed surface having a first portion forming a reduced contact area in slidable contact with said cutting edge and a second portion avoiding contact with said cutting edge.

32. A sheet sorting apparatus according to claim 31, wherein said cutting portion further comprises a second fixed surface upon which said first fixed surface is mounted, said second fixed surface at least partially extending said second portion away from said cutting edge.

33. A sheet sorting method for pasting a tag on a predetermined sheet discharged from an image processing apparatus, comprising the steps of:

selecting either a first path to transfer a sheet wherein said tag is pasted on said sheet or a second path to transfer said sheet, wherein said selecting is based on a signal from said image processing apparatus; when said first path is selected:

transferring said sheet to said first path;

drawing out a band tape using draw-out rollers;

cutting said band tape and producing said tag; and pasting said tag on said sheet.

34. A sheet sorting method according to claim 33, wherein said transferring of the sheet utilizes a driving force of said image processing apparatus.

35. A sheet sorting method according to claim 33, wherein said cutting of band tape varies a width of said tag according to a signal from said image processing apparatus.

36. A sheet sorting method according to claim 33, wherein said drawing and said cutting are driven by the same motor.

37. A sheet sorting method according to claim 33, wherein said method further comprises detecting the position of a cutting assembly for said cutting of said band tape.

38. A sheet sorting method according to claim 37, wherein said step of detecting further comprises transmitting a different signal to said control assembly according to a detected position of said cutting assembly.

39. A sheet sorting method according to claim 33, wherein said method further comprises storing a tag not pasted on said sheet in a storage assembly.

40. A sheet sorting method according to claim 39, wherein said method further comprises detecting an amount of said tags stored in said storage assembly.

41. A sheet sorting method for pasting a tag on a predetermined sheet discharged from an image processing apparatus, comprising the steps of:

judging a change of a processing demand signal;

changing a position of a flapper to direct said sheet to one of at least two paths;

drawing out a band tape of a specified length;

preparing said tag by cutting said band tape; and pasting said tag on said sheet.

* * * * *